US011222562B2

(12) United States Patent
Gao et al.

(10) Patent No.: US 11,222,562 B2
(45) Date of Patent: Jan. 11, 2022

(54) DISPLAY PANEL, METHOD FOR DETECTING THE SAME AND DISPLAY DEVICE

(71) Applicant: Shanghai Tianma AM-OLED Co., Ltd., Shanghai (CN)

(72) Inventors: Yana Gao, Shanghai (CN); Xingyao Zhou, Shanghai (CN); Xinzhao Liu, Shanghai (CN); Zhi Liu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 17/212,394

(22) Filed: Mar. 25, 2021

(65) Prior Publication Data

US 2021/0209979 A1 Jul. 8, 2021

(30) Foreign Application Priority Data

Nov. 27, 2020 (CN) ..... 202011364419.7

(51) Int. Cl.
*G09G 3/00* (2006.01)
*G09G 3/20* (2006.01)

(52) U.S. Cl.
CPC ..... *G09G 3/006* (2013.01); *G09G 3/2092* (2013.01); *G09G 2310/0275* (2013.01); *G09G 2310/0297* (2013.01)

(58) Field of Classification Search
CPC ..... G09G 3/006; G09G 3/2092; G09G 2310/0297
See application file for complete search history.

(56) References Cited

U.S. PATENT DOCUMENTS

| | | | | |
|---|---|---|---|---|
| 9,875,676 | B2 * | 1/2018 | Byun | G09G 3/20 |
| 10,210,782 | B2 * | 2/2019 | Lee | G09G 3/006 |
| 10,522,431 | B2 * | 12/2019 | Kim | G09G 3/006 |
| 10,861,361 | B2 * | 12/2020 | Kim | G09G 3/3266 |
| 10,891,883 | B2 * | 1/2021 | Jung | G09G 3/3225 |
| 11,120,714 | B2 * | 9/2021 | Lee | G09G 3/006 |

* cited by examiner

*Primary Examiner* — Sardis F Azongha
(74) *Attorney, Agent, or Firm* — Christensen O'Connor Johnson Kindness PLLC

(57) ABSTRACT

A display panel, a method for detecting the same, and a display device are provided. The display panel has a display area provided with data lines therein, and a non-display area provided with fan-out lines, a crack detection line, multiplexers, a first crack detection switch, and a crack detection control signal line therein. The crack detection line includes first and second detection sub-lines connected to each other. The first detection sub-line and the second detection sub-line are respectively connected to an input terminal of the first crack detection switch and a crack detection signal terminal. An output terminal of the demultiplexer is electrically connected to n data lines. An input terminal of the first demultiplexer is connected to an output terminal of the first crack detection switch and one fan-out line, and a control terminal of the first crack detection switch is connected to the crack detection control signal line.

20 Claims, 19 Drawing Sheets

S501

Controlling the three test control lines to sequentially provide an effective level signal to control the three selection switches to be turned on sequentially, and at the same time, controlling the crack detection control signal line to provide an ineffective level signal to control the first crack detection switch to be turned off; and sequentially providing, by the three selection switches, a display test signal provided by the test signal lines connected to the input terminals thereof to the input terminal of the first demultiplexer, and controlling the first demultiplexer to provide the display test signal to the n data lines electrically connected to the first demultiplexer

FIG. 22

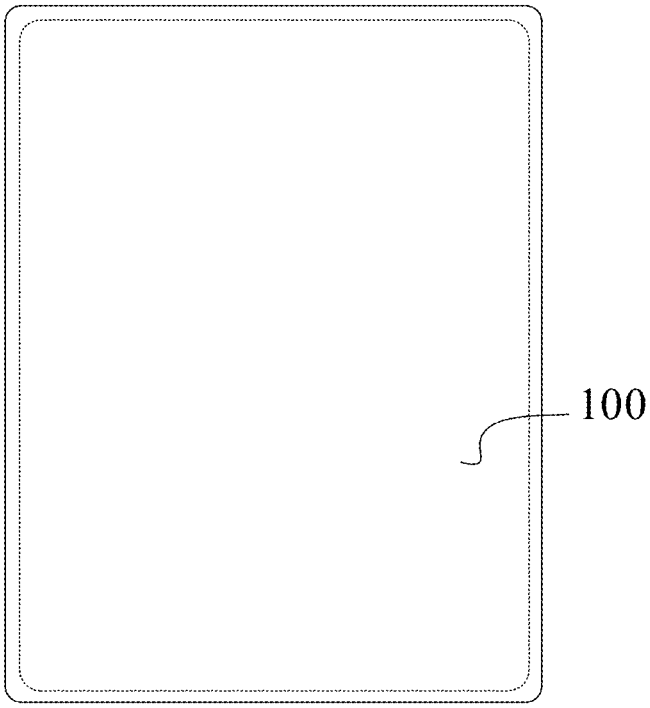

FIG. 23

DISPLAY PANEL, METHOD FOR DETECTING THE SAME AND DISPLAY DEVICE

CROSS-REFERENCE TO RELATED APPLICATIONS

The present application claims priority to Chinese Patent Application No. 202011364419.7, filed on Nov. 27, 2020, the content of which is incorporated herein by reference in its entirety.

TECHNICAL FIELD

The present disclosure relates to the field of display technology and, in particular, to a display panel, a method for detecting the display panel and a display device.

BACKGROUND

In the related art, a process for manufacturing a display panel may cause a crack at an edge of the display panel, while the crack at the edge will cause a line near a border of the display panel to be broken, and if the crack extends from the edge of the display panel to an interior of the display area, it will affect lines or circuits in the display area. In other words, the crack at the edge of the display panel seriously affects performance of the display panel, and, accordingly, detection of cracks at the edge of the display panel before the display panel leaves a factory has become an important step. In order to detect cracks in the display panel, a crack detection module is generally provided in the display panel. In other words, a circuit will be provided in a non-display area of the display panel, thereby increasing burden of the non-display area, resulting in an increase in an overall area of the non-display area, and affecting a screen-to-body ratio.

SUMMARY

In a first aspect, an embodiment of the present disclosure provides a display panel, and the display panel includes a display area and a non-display area at least partially surrounding the display area, and the non-display area includes a fan-out area. The display panel includes: a plurality of fan-out lines arranged in the fan-out area; a plurality of data lines arranged in the display area; and a plurality of demultiplexers, a crack detection line, a first crack detection switch and a crack detection control signal line that are arranged in the non-display area. The crack detection line and the first crack detection switch are configured to detect whether there is a crack in the display panel, and the first crack detection switch includes an input terminal electrically connected to the crack detection line, an output terminal, and a control terminal electrically connected to the crack detection control signal line. Each of the plurality of demultiplexers includes an output terminal electrically terminal connected to n data lines of the plurality of data lines, an input terminal and a control terminal and is configured to provide a signal of the input terminal to one of the n data lines connected to the demultiplexer under control of a signal of the control terminal, where n is a positive integer, and n≥2. The plurality of the demultiplexers includes a first demultiplexer, and the input terminal of the first demultiplexer is connected to the output terminal of the first crack detection switch and one of the plurality of fan-out lines.

In a second aspect, an embodiment of the present disclosure further provides a method for detecting a display panel.

The display panel has a display area and a non-display area at least partially surrounding the display area, and the non-display area includes a fan-out area. The display panel includes: a plurality of fan-out lines arranged in the fan-out area; a plurality of data lines arranged in the display area; and a plurality of demultiplexers, a crack detection line, a first crack detection switch and a crack detection control signal line that are arranged in the non-display area. The crack detection line surrounds the display area and includes a first detection sub-line and a second detection sub-line that are connected to each other, wherein the first detection sub-line and the second detection sub-line each extend along a first direction; along a second direction intersecting with the first direction, there is a gap between an orthographic projection of the first detection sub-line on a light-exiting surface of the display panel and an orthographic projection of the second detection sub-line on the light-exiting surface of the display panel; and the first detection sub-line is connected to an input terminal of the first crack detection switch, and the second detection sub-line is connected to a crack detection signal terminal. Each of the plurality of demultiplexers includes output terminals electrically connected to n data lines of the plurality of data lines, respectively, an input terminal and at least one control terminal, and is configured to provide a signal of the input terminal of the demultiplexer to one of the plurality of data lines under control of a signal of one of the at least one control terminal, where n is a positive integer, and n≥2; and the plurality of the demultiplexers includes a first demultiplexer, wherein the first demultiplexer includes an input terminal connected to an output terminal of the first crack detection switch and one of the plurality of fan-out lines. A control terminal of the first crack detection switch is electrically connected to the crack detection control signal line. The method includes: providing a crack detection signal to the crack detection line; at a first moment, controlling the first crack detection switch to be turned on in such a manner that the first crack detection switch provides a first voltage signal of the input terminal of the first crack detection switch to the input terminal of the first demultiplexer, and at the same time, providing a test signal to the input terminal of the first demultiplexer through the one of the plurality of fan-out lines, and controlling the first demultiplexer to provide a second voltage signal to the n data lines electrically connected to the first demultiplexer; at a second moment, controlling the first crack detection switch to be turned off, and at the same time, providing the test signal to the input terminal of the first demultiplexer through the one of the plurality of fan-out lines, and controlling the first demultiplexer to provide a third voltage signal to the n data lines electrically connected to the first demultiplexer; determining whether the crack detection line is broken based on a brightness difference obtained by comparing brightness of a part of the display area where the n data lines electrically connected to the first demultiplexer are located at the first moment and brightness of the part of the display area where the n data lines electrically connected to the first demultiplexer are located at the second moment.

In a third aspect, an embodiment of the present disclosure further provides a method for detecting a display panel. The display panel has a display area and a non-display area at least partially surrounding the display area, and the non-display area includes a fan-out area. The display panel includes: a plurality of fan-out lines arranged in the fan-out area; a plurality of data lines arranged in the display area; a plurality of demultiplexers, a crack detection line, a first crack detection switch, a crack detection control signal line, and a display test module that are arranged in the non-display area. The crack detection line surrounds the display area and includes a first detection sub-line and a second detection sub-line that are connected to each other, wherein the first detection sub-line and the second detection sub-line each extend along a first direction; along a second direction intersecting with the first direction, there is a gap between an orthographic projection of the first detection sub-line on a light-exiting surface of the display panel and an orthographic projection of the second detection sub-line on the light-exiting surface of the display panel; and the first detection sub-line is connected to an input terminal of the first crack detection switch, and the second detection sub-line is connected to a crack detection signal terminal. Each of the plurality of demultiplexers includes output terminals electrically connected to n data lines of the plurality of data lines, respectively, an input terminal and at least one control terminal, and is configured to provide a signal of the input terminal of the demultiplexer to one of the plurality of data lines under control of a signal of one of the at least one control terminal, where n is a positive integer, and n≥2; and the plurality of the demultiplexers includes a first demultiplexer, wherein the first demultiplexer includes an input terminal connected to an output terminal of the first crack detection switch and one of the plurality of fan-out lines. A control terminal of the first crack detection switch is electrically connected to the crack detection control signal line; each of the plurality of demultiplexers includes at least one first distribution switch, wherein each of the at least one first distribution switch includes an input terminal electrically connected to the input terminal of the demultiplexer, and an output terminal electrically connected to a first data line of the plurality of data lines; and the first data line is connected to a plurality of sub-pixels of a first color. The display test module includes three test signal lines, three test control lines, and a plurality of display test units, wherein each of display test units includes at least three selection switches, wherein each of the at least three selection switches includes a control terminal electrically connected to one of the three test control lines, an input terminal electrically connected to one of the three test signal lines, and an output terminal; and the output terminals of the at least three selection switches are electrically connected to the input terminal of one of the plurality of demultiplexers. A control terminal of the first distribution switch is electrically connected to one of the three test control lines. The method further includes: providing a crack detection signal to the crack detection line; at a first moment, controlling the first crack detection to be turned on in such a manner that the first crack detection switch provides a first voltage signal of the input terminal of the first crack detection switch to the input terminal of the first demultiplexer, and at the same time, controlling the output terminals of the at least three selection switches to provide a test signal to the input terminal of the first demultiplexer, and controlling the first demultiplexer to provide a second voltage signal to the n data lines electrically connected to the first demultiplexer; and at a second moment, controlling the first crack detection switch to be turned off, and at the same time, controlling the output terminals of the at least three selection switches to provide the test signal to the input terminal of the first demultiplexer, and controlling the first demultiplexer to provide a third voltage signal to the n data lines electrically connected to the first demultiplexer.

In a fourth aspect, an embodiment of the present disclosure further provides a display device including the display panel described in the first aspect.

BRIEF DESCRIPTION OF DRAWINGS

In order to more clearly illustrate the embodiments of the present disclosure or the technical solutions in the related art, the accompanying drawings used in the description of the embodiments or the related art will be briefly introduced below. Obviously, the drawings in the following description are some embodiments of the present disclosure, and for those skilled in the art, other drawings can be obtained based on these drawings.

FIG. 22 is a flowchart of a detection method for a display panel provided by an embodiment of the present disclosure; and FIG. 23 is a schematic diagram of a display device provided by an embodiment of the present disclosure.

DESCRIPTION OF EMBODIMENTS

To make technical solutions of the embodiments of the present disclosure clearer, the technical solutions in the embodiments of the present disclosure will be described clearly and completely in conjunction with the drawings in the embodiments of the present disclosure. Obviously, the embodiments described are a part of the embodiments of the present disclosure, but not all the embodiments. Based on the embodiments of the present disclosure, other embodiments obtained by those of ordinary skill in the art fall within the protection scope of the present disclosure.

The terms used in the embodiments of the present disclosure are merely for the purpose of describing particular embodiments and not intended to limit the present disclosure. Unless otherwise noted in the context, the singular form expressions "a", "an", "the" and "said" used in the embodiments and appended claims of the present disclosure are also intended to represent a plural form.

Figure 1:
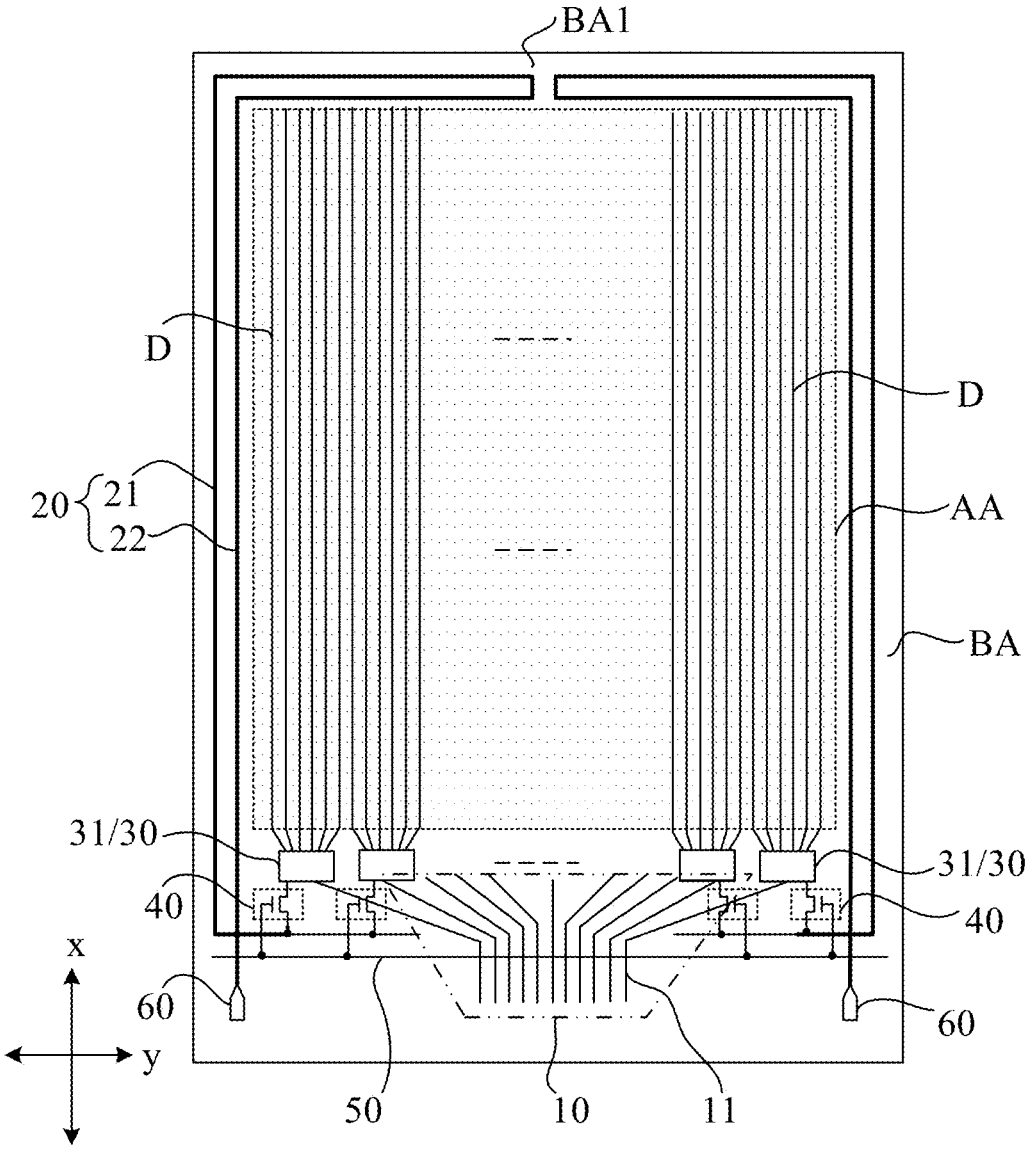
FIG. 1 is a schematic diagram of a display panel provided by an embodiment of the present disclosure.
Figure 2:
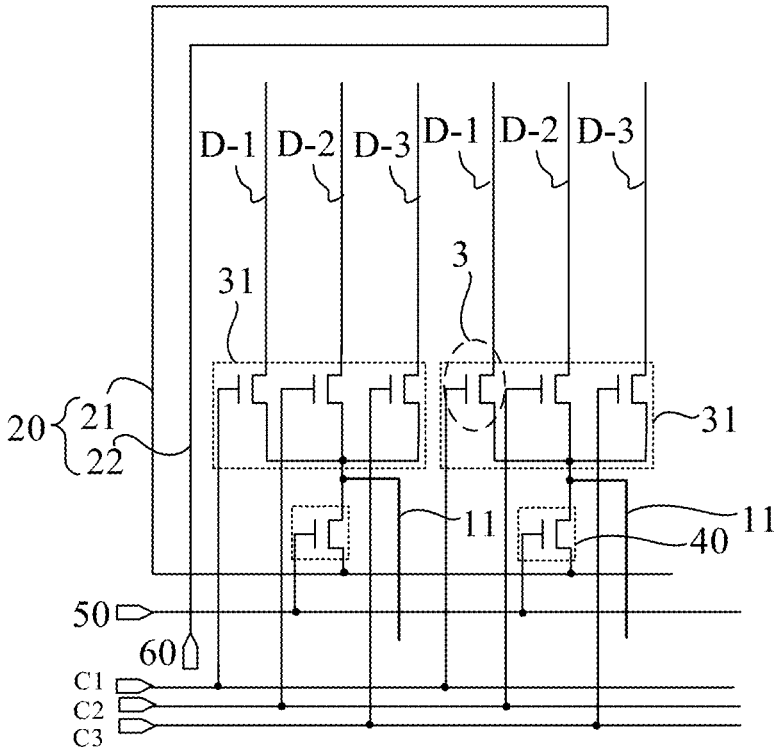
FIG. 2 is a schematic diagram of a circuit in a display panel provided by an embodiment of the present disclosure.

FIG. 1 is a schematic diagram of a display panel provided by an embodiment of the present disclosure. FIG. 2 is a schematic diagram of a circuit in a display panel provided by an embodiment of the present disclosure.

As shown in FIG. 1, the display panel includes a display area AA and a non-display area BA at least partially surrounding the display area AA, the non-display area BA includes a fan-out area 10, and a plurality of fan-out lines 11 are provided in the fan-out area 10. Multiple data lines D are arranged in the display area AA. A crack detection line 20, at least one demultiplexer 30, a first crack detection switch 40, and a crack detection control signal line 50 are arranged in the non-display area BA. The crack detection line 20 and the first crack detection switch 40 are configured to cooperate with each other to detect whether there is a crack in the display panel.

A plurality of sub-pixels arranged in an array is arranged in the display area AA of the display panel, one of the data lines D is electrically connected to a plurality of the sub-pixels, and the data line D is configured to provide data signals to the sub-pixels to control the sub-pixels to emit light. A magnitude of a voltage signal provided by the data line D to the sub-pixels affects brightness of the light emission of the sub-pixels.

The crack detection line 20 surrounds the display area AA, and the crack detection line 20 includes a first detection sub-line 21 and a second detection sub-line 22 that are connected to each other. The first detection sub-line 21 extends along a first direction x, and the second detection sub-line 22 extends along the first direction x. Along a second direction y, there is a gap between an orthographic projection of the first detection sub-line 21 on a light-exiting surface of the display panel and an orthographic projection of the second detection sub-line 22 on the light-exiting surface of the display panel. The projection of the first detection sub-line 21 and the projection of the second detection sub-line 22 are not shown in FIG. 1, FIG. 1 illustrates a top view of the display panel, and it can be understood that a direction of looking down on the display panel is the same as a direction of projecting on the light-exiting surface of the display panel, then when viewing from a top view, the orthographic projection of the first detection sub-line 21 on the light-exiting surface of the display panel coincides with the first detection sub-line 21, and the orthographic projection of the second detection sub-line 22 on the light-exiting surface of the display panel coincides with the second detection sub-line 22. It can be seen from the drawing that the first detection sub-line 21 and the second detection sub-line 22 are located on the same side of the display area AA, the first detection sub-line 21 is connected to an input terminal of the first crack detection switch 40, the second detection sub-line 22 is connected to a crack detection signal terminal 60, and the first direction x and the second direction y intersect with each other.

FIG. 1 schematically illustrates that along the second direction y, both sides of the display area AA are respectively provided with the crack detection lines 20. Both the first detection sub-line 21 and the second detection sub-line 22 extend to the first non-display area BA1 of the display area AA, and in the first direction x, the first non-display area BA1 and the fan-out area 10 are respectively located on two sides of the display area AA. The first detection sub-line 21 and the second detection sub-line 22 are connected in the first non-display area BA1.

In the embodiment of the present disclosure, the crack detection line 20 surrounds the display area AA, the crack detection line 20 is provided in the non-display area BA, the crack detection line 20 is closer to an edge of the display panel than the display area AA, and when there is a crack on the edge of the display panel, the crack will cause the crack detection line 20 to be broken, then the crack detection line 20 cannot transmit signals; when there is no crack on the edge of the display panel, the crack detection line 20 will not be broken due to the crack, and the crack detection line 20 can transmit signals. Therefore, whether there is a crack at the edge of the display panel can be determined by detecting whether the crack detection line 20 is broken.

A shape of the display area AA in FIG. 1 is only a schematic illustration. In the display panel provided by the embodiment of the present disclosure, the display area AA can be in a shape such as circular, rectangular, oval, etc., and the display area AA can also be in an irregular shape. For example, the display area AA has a notch on a side away from the fan-out area 10, or the display area AA has a notch on an edge extending along the first direction x.

Referring to FIG. 1 and FIG. 2 in conjunction, an output terminal of the demultiplexer 30 is electrically connected to n data lines D, where n is a positive integer and $n \geq 2$, and the demultiplexer 30 is configured to provide the signal of the input terminal thereof to a corresponding data line D under control of a signal at a control terminal thereof. The present disclosure does not limit the number of the data lines D connected to one demultiplexer 30, and n can be 3, 6, 9, 12, etc. and can be set according to specific design requirements in practice.

The multiple demultiplexers 30 include a first demultiplexer 31, an input terminal of the first demultiplexer 31 is connected to an output terminal of the first crack detection switch 40 and one fan-out line 11, and a control terminal of the first crack detection switch 40 is electrically connected to the crack detection control signal line 50.

In an embodiment, as shown in FIG. 1 and FIG. 2, the first crack detection switch 40 includes a switching transistor, a gate of the switching transistor is the control terminal of the first crack detection switch 40, an input terminal of the switching transistor is connected to the first detection sub-line 21, and an output terminal of the switching transistor is connected to the input terminal of the first demultiplexer 31.

In the embodiment of the present disclosure, the crack detection line 20 is electrically connected to the input terminal of the first demultiplexer 31 through the first crack detection switch 40. Specifically, the crack detection signal terminal 60 is configured to provide a crack detection signal, and when the crack detection line 20 is not broken, the crack detection signal is first transmitted on the second detection sub-line 22, and then transmitted to the first detection sub-line 21 via the second detection sub-line 22, then the first detection sub-line 21 provides the crack detection signal to the input terminal of the first crack detection switch 40. When the first crack detection switch 40 is controlled to be turned on, the first crack detection switch 40 can provide the crack detection signal to the input terminal of the first demultiplexer 31, so that by controlling the first demultiplexer 31, the crack detection signal can be controlled to be provided to the corresponding data line D. When the crack detection line 20 is broken, the first detection sub-line 21 and the second detection sub-line 22 cannot cooperate to provide the crack detection signal to the input terminal of the first crack detection switch 40.

FIG. 2 shows that the output terminals of one first demultiplexer 31 are electrically connected to three data lines D, respectively. In an embodiment, the first demultiplexer 31 includes three distribution switches 3, and one data line D corresponds to one distribution switch 3, that is, when one demultiplexer includes three distribution switches 3, the demultiplexer includes three output terminals, the output terminal of each of the distribution switches 3 is used as one output terminal of the demultiplexer, one output terminal of each distribution switch 3 is electrically connected to one data line D, and it is illustrated in the drawing that the data lines respectively connected to the three distribution switches 3 are respectively a data line D-1, a data line D-2, and a data line D-3. The control terminals of the three distribution switches 3 are respectively connected to a distribution control signal wire C1, a distribution control signal wire C2, and a distribution control signal wire C3. When the distribution control signal wire C1 provides an effective level signal, the distribution switch 3 connected to the distribution control signal wire C1 is turned on, to be capable of providing the signal of the input terminal of the first demultiplexer 31 to the data line D-1, and the data line D-1 can further control, according to a voltage signal it receives, the sub-pixel connected thereto to emit light. Correspondingly, when the distribution control signal wire C2 provides an effective level signal, it is possible to control to provide the signal of the input terminal of the first demultiplexer 31 to the data line D-2, and the data line D-2 can further control, according to a voltage signal it receives, the sub-pixel connected thereto to emit light. Similarly, when the distribution control signal wire C3 provides an effective level signal, the data line D-3 can receive the signal of the input terminal of the first demultiplexer 31, and control, according to a voltage signal, the sub-pixel connected to the data line D-3 to emit light.

In the related art, crack detection is performed on the display panel before it leaves a factory, and after the crack detection is completed, it is necessary to ensure that the display panel can display normally. If it is set that an output terminal of one crack detection switch is connected to multiple data lines, then it can be determined that the multiple data lines are short-circuited by the output terminal of the crack detection switch, and after the crack detection is completed, the multiple data lines that are short-circuited to each other cannot transmit data signals individually, which will affect the normal display of the display panel. Therefore, in order to realize the crack detection and make the display panel display normally after the detection, it is necessary to set that one crack detection switch corresponds to one data line, causing that a large number of the crack detection switches need to be provided to realized the crack detection, thereby greatly increasing an area of the non-display area of the display panel.

In the display panel provided by an embodiment of the present disclosure, the crack detection line is provided to be electrically connected to the input terminal of the first demultiplexer through the first crack detection switch, the output terminals of one first demultiplexer are respectively connected to n data lines, so that one first crack detection switch is electrically connected to the n data lines through the first demultiplexer. During the crack detection, the crack detection line can provide the crack detection signal to n data lines through one first crack detection switch, for determining whether there is a crack in the display panel. Moreover, the input terminal of the first demultiplexer is electrically connected to one fan-out line, in a non-crack detection phase, the signal is provided to the input terminal of the first demultiplexer through the fan-out line, and by controlling the first demultiplexer, the signal transmitted by the fan-out line can be provided to the corresponding data line, thereby realizing the detection of the fan-out line or realizing functions such as display of the display panel. In other words, the first demultiplexer in the embodiment of the present disclosure can be multiplexed in the crack detection phase and the non-crack detection phase. The embodiment of the present disclosure performs the crack detection through the cooperation of the first crack detection switch and the first demultiplexer and multiplexes an original multiplexer structure in the display panel to realize the crack detection, which increases an integration level of the display panel, can reduce the number of the crack detection switches compared with the related art and can save space in the non-display area.

Specifically, the fan-out line 11 is a data signal line, and the data signal line provides a data signal to the data line D during the display phase of the display panel. The fan-out line 11 is electrically connected to the input terminal of the first demultiplexer 31, and the output terminals of the first demultiplexer 31 are respectively electrically connected to the n data lines D, so that one fan-out line 11 corresponds to the n data lines, and when the display panel displays, the data signal can be provided, in a time-division manner, by one fan-out line 11 to the n data lines D respectively, to control the sub-pixels connected to the data lines D to emit light. The first demultiplexer 31 are provided to reduce the number of the fan-out lines arranged in the non-display area, thereby reducing the space occupied by the entire fan-out lines in the non-display area. Moreover, reduction in the number of the fan-out lines is also conducive to reducing the number of pins of a driver chip. In this embodiment, the output terminal of the first crack detection switch is provided to be electrically connected to the input terminal of the demultiplexer (the first demultiplexer) for display, and during the crack detection, through the cooperation of the first crack detection switch with the first demultiplexer, it is realized that signals are provided to the n data lines through one first crack detection switch, to determine whether the crack detection line is broken. The number of the crack detection switches used for crack detection can be reduced, which is beneficial to save the space of the non-display area, and also increases the integration level of the display panel.

Figure 3:
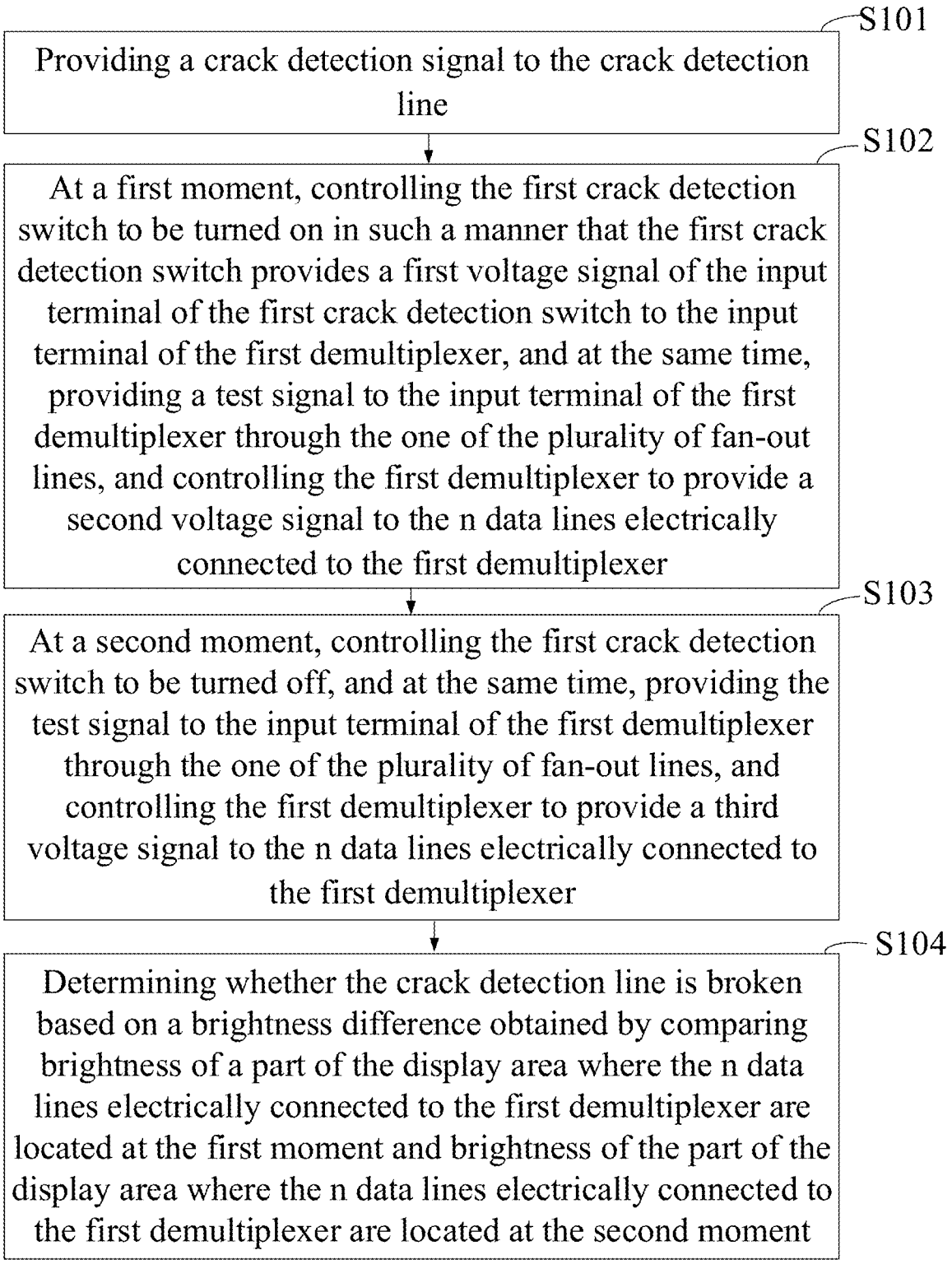
FIG. 3 is a flowchart of a method for detecting a display panel provided by an embodiment of the present disclosure.

Further, an embodiment of the present disclosure also provides a method for detecting a display panel, which can be used to detect the display panel provided in the embodiment of FIG. 1 and FIG. 2. FIG. 3 is a flowchart of a method for detecting the display panel provided by an embodiment of the present disclosure. As shown in FIG. 3, the method includes step 101, step 102, step 103, and step 104.

At step S101, a crack detection signal is provided to the crack detection line 20. Specifically, the crack detection signal is provided to the crack detection line 20 through the crack detection signal terminal 60. When the crack detection line 20 is not broken, the crack detection signal can be provided to the input terminal of the first crack detection switch 40 after being transmitted through the second detection sub-line 22 and the first detection sub-line 21. When the crack detection line 20 is broken, the crack detection signal cannot be provided to the input terminal of the first crack detection switch 40 after being transmitted through the second detection sub-line 22 and the first detection sub-line 21, that is, when the crack detection line 20 is broken, the input terminal of the first crack detection switch 40 cannot receive the crack detection signal.

At step S102, at a first moment t1, the first crack detection switch 40 is controlled to be turned on, the first crack detection switch 40 provides a first voltage signal at the input terminal thereof to the input terminal of the first demultiplexer 31, and at the same time, a test signal is provided to the input terminal of the first demultiplexer 31 through the fan-out line 11, to control the first demultiplexer 31 to provide a second voltage signal to the n data lines D electrically connected thereto. One data line D drives multiple sub-pixels to emit light, and after controlling the first demultiplexer 31 to provide the second voltage signal to the n data lines D electrically connected thereto, the display area where the sub-pixels connected to the n data lines are located emits light for display. Specifically, by controlling the crack detection control signal line 50 to provide an effective level signal to the control terminal of the first crack detection switch 40, the first crack detection switch 40 is controlled to be turned on.

In this step, if the crack detection line 20 is not broken, the crack detection line 20 provides the crack detection signal to the input terminal of the first crack detection switch 40, and when the first crack detection switch 40 is turned on, the first crack detection switch 40 can provide the crack detection signal to the input terminal of the first demultiplexer 31, and at the same time, the fan-out line 11 provides the test signal to the input terminal of the first demultiplexer 31. That is, the fan-out line 11 and the output terminal of the first crack detection switch 40 simultaneously input signals to the input terminal of the first demultiplexer 31, then the first demultiplexer 31 provides a combined signal to the corresponding data line D. At this time, the fan-out line 11 and the output terminal of the first crack detection switch 40 are short-circuited, to further output a voltage whose value is between a voltage value of the test signal (provided by the fan-out line 11) and a voltage value of the crack detection signal (provided by the output terminal of the first crack detection switch 40) to the input terminal of the first demultiplexer 31, that is, a voltage value of the combined signal is between the voltage value of the test signal and the voltage value of the crack detection signal. The voltage value of the voltage signal provided to the input terminal of the first demultiplexer 31 depends on a voltage generated by the resistance of the fan-out line 11 and a voltage generated by the resistance of the crack detection line 20. The data line D provides the combined signal to the sub-pixels electrically connected to the data line D, to control the sub-pixels to emit light.

When the crack detection line 20 is broken, the crack detection line 20 cannot provide the crack detection signal to the input terminal of the first crack detection switch 40, and when the first crack detection switch 40 is turned on, the voltage value provided by the input terminal the first crack detection switch 40 to the input terminal of the first demultiplexer 31 is zero. In this case, at the step S102, the input terminal of the first demultiplexer 31 only receives the test signal provided by the fan-out line 11 to the input terminal thereof, then the first demultiplexer 31 will provide the test signal to the corresponding data line D according to the control of the control signal, and the data line D then provides the test signal to the sub-pixel connected thereto, to control the sub-pixel to emit light.

In other words, when the crack detection line 20 is in unbroken and broken states, at the first moment t1, the voltage signals received by the input terminal of the first demultiplexer 31 are different. Furthermore, the magnitudes of the voltage signals provided to the corresponding data line D are different, and then the brightness of the sub-pixels connected to the data line D is correspondingly different. In an embodiment, when the voltage value of the crack detection signal (provided by the output terminal of the first crack detection switch 40) is greater than the voltage value of the test signal (provided by the fan-out line 11), the voltage value of the signal received by the input terminal of the first demultiplexer 31 when the crack detection line 20 is not broken is greater than the voltage value of the signal received by the input terminal of the first demultiplexer 31 when the crack detection line 20 is broken, then, correspondingly, the brightness of the display area where the sub-pixels driven by the n data lines D connected to the first demultiplexer 31 are located when the crack detection line 20 is not broken is smaller than the brightness of the display area when the crack detection line 20 is broken.

At step S103, at a second moment t2, the first crack detection switch 40 is controlled to be turned off, and at the same time, a test signal is provided to the input terminal of the first demultiplexer 31 through the fan-out line 11, and the test signal has the same magnitude as the test signal provided by the fan-out line 11 at the step S102; the first demultiplexer 31 is controlled to provide a third voltage signal to the n data lines D electrically connected thereto. Specifically, by controlling the crack detection control signal line 50 to provide an ineffective level signal to the control terminal of the first crack detection switch 40, the first crack detection switch 40 is controlled to be turned off. In this step, the first crack detection switch 40 is controlled to be turned off, only the fan-out line 11 provides a signal to the input terminal of the first demultiplexer 31, and correspondingly, the first demultiplexer 31 will provide a test signal to the corresponding data line D according to the control signal, and the data line D then provides the test signal to the sub-pixels connected thereto, to control the sub-pixels to emit light. At the step S103, regardless of whether the crack detection line 20 is broken, at the second moment t2, the brightness of the display area where the n data lines D electrically connected to the first demultiplexer 31 are located does not change, then the brightness of the display area where the n data lines D electrically connected to the first demultiplexer 31 are located at the second moment t2 can be used as a comparative example, and by comparing a brightness of the display area where the n data lines D are located at the first moment t1 and the second moment t2, a brightness difference can be obtained to determine whether the corresponding crack detection line 20 is broken.

At step S104, whether the crack detection line 20 is broken is determined based on a brightness difference obtained by comparing the brightness of the display area where the n data lines D electrically connected to the first demultiplexer 31 are located at the first moment t1 and the brightness of the display area where the n data lines D electrically connected to the first demultiplexer 31 are located at the second moment t2. This method has a more accurate detection result without taking the impedance of the crack detection line itself into account.

Figure 4:
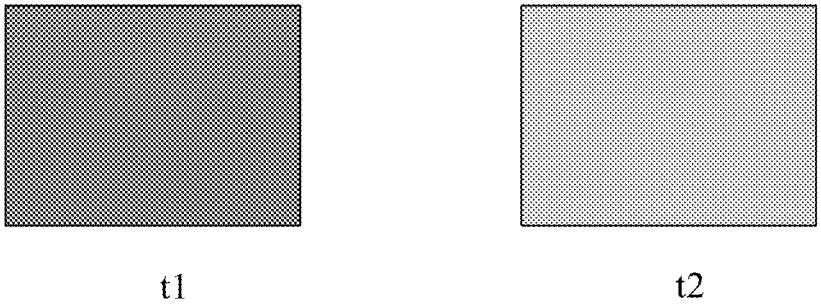
FIG. 4 is a first schematic diagram of brightness comparison of a partial display area of a display panel at a first moment and a second moment, according to an embodiment of the present disclosure.
Figure 5:
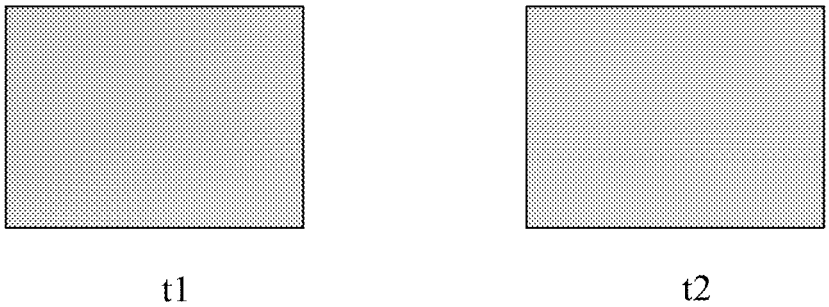
FIG. 5 is a second schematic diagram of brightness comparison of a partial display area of a display panel at a first moment and a second moment, according to an embodiment of the disclosure.

A method for determining whether the crack detection line 20 is broken at step S104 is described below as an example. FIG. 4 is a first schematic diagram of brightness comparison of a partial display area of the display panel at the first moment and the second moment, and FIG. 5 is a second schematic diagram of the brightness comparison of the partial display area of the display panel at the first moment and the second moment. In the embodiment of the present disclosure, one first demultiplexer is electrically connected to n data lines, that is, one first demultiplexer corresponds to n data lines, and the diagrams in FIGS. 4 and 5 show the same display area, this same display area can be a display area where multiple data lines corresponding to the same first demultiplexer 31 are located, the same display area can also be a display area where multiple data lines corresponding to multiple first demultiplexers 31 are located.

As shown in FIG. 4, the brightness of the display area at the first moment t1 is relatively dark, and the brightness of the display area is relatively bright at the second moment t2, that is, the brightness of the display area at the first moment t1 is smaller than the brightness thereof at the second moment t2, from which it can be determined that the voltage signals received by the input terminal of the first demultiplexer 31 are different at the first moment t1 and the second moment t2. It shows that at the first moment t1, the input terminal of the first demultiplexer 31 simultaneously receives a voltage signal (i.e., the test signal) provided thereto by the fan-out line 11 and the first voltage signal provided thereto by the first crack detection switch 40, so that it can be determined that the crack detection line 20 is not broken.

As shown in FIG. 5, the brightness of the display area at the first moment t1 is basically the same as the brightness thereof at the second moment t2, from which it can be determined that at the first moment t1 and the second moment t2, the voltage signals received by the input terminal of the first demultiplexer 31 are the same. It shows that at the first moment t1 and the second moment t2, the input terminal of the first demultiplexer 31 only receives the voltage signal (i.e., the test signal) provided thereto by the fan-out line 11, so that it can be determined that the crack detection line 20 is broken.

The display panel provided by the embodiment of the present disclosure can apply the method provided in the above steps S101 to S104 to determine whether the crack detection line is broken, to further determine whether there is a crack at the edge of the display panel, so as to detect defective products before they leave the factory.

Figure 6:
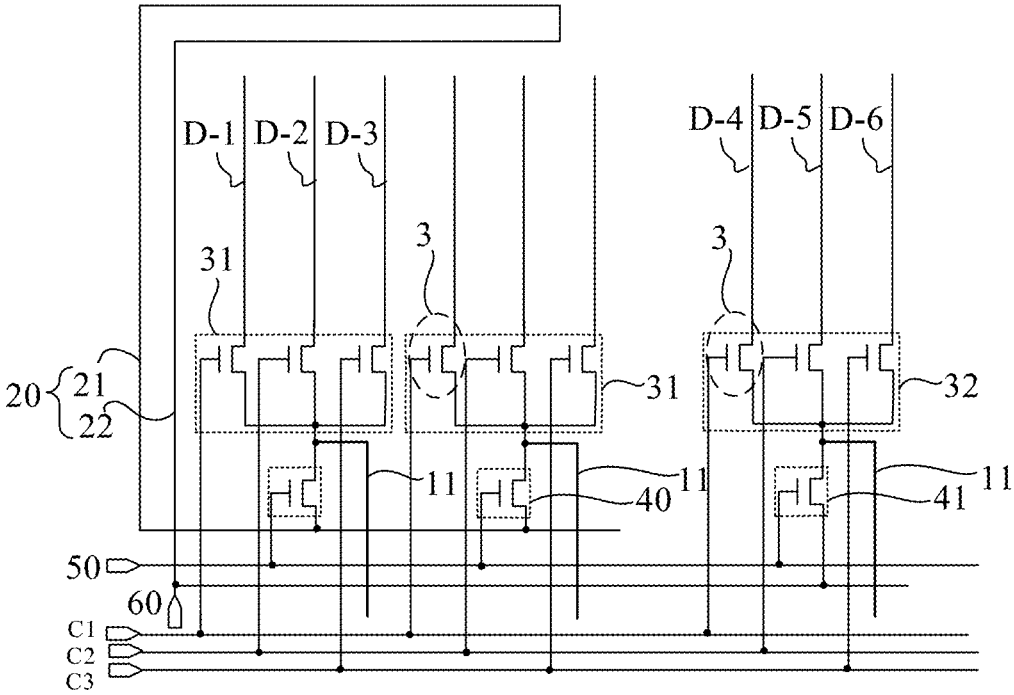
FIG. 6 is a schematic diagram of a circuit in a display panel provided by an embodiment of the present disclosure.

FIG. 6 is a schematic diagram of a circuit of the display panel according to an embodiment of the present disclosure. In an embodiment, as shown in FIG. 6, the display panel includes a second crack detection switch 41 provided in the non-display area, the multiple demultiplexers 30 include a second demultiplexer 32, a control terminal of the second crack detection switch 41 is electrically connected to the crack detection control signal line 50, an input terminal of the second crack detection switch 41 is electrically connected to the crack detection signal terminal 60, and an output terminal of the second crack detection switch 41 is electrically connected to the input terminal of the second demultiplexer 32. An input terminal of the second demultiplexer 32 is further electrically connected to one fan-out line 11. In FIG. 6, as an example, the output terminal of one demultiplexer is connected to three data lines D. The data lines corresponding to the first demultiplexer 40 are the data line D-1, the data line D-2 and the data line D-3 respectively; data lines corresponding to the second demultiplexer 32 are a data line D-4, a data line D-5, and a data line D-6, respectively. A working process of the second demultiplexer 32 can be referred to the description of the working process of the first demultiplexer 31 in the embodiment of FIG. 2, which will not be repeated herein.

In the embodiment of the present disclosure, the input terminal of the first crack detection switch 40 is connected to the first detection sub-line 21, the first detection sub-line 21 is a partial segment of the crack detection line 20, the crack detection signal terminal 60 provides a crack detection signal to the second detection sub-line 22 of the crack detection line 20, the crack detection signal is transmitted to the first detection sub-line 21 from the second detection sub-line 22 and then provided to the input terminal of the first crack detection switch 40 through the first detection sub-line 21. That is, the input terminal of the first crack detection switch 40 is electrically connected to the crack detection line 20, while the input terminal of the second crack detection switch 41 is directly electrically connected to the crack detection signal terminal 60. Then, no matter whether the crack detection line 20 is broken, the input terminal of the second crack detection switch 41 can receive the crack detection signal provided by the crack detection signal terminal 60, while when the crack detection line 20 is broken, the input terminal of the first crack detection switch 40 cannot receive the crack detection signal provided by the crack detection signal terminal 60. Moreover, even when the crack detection line 20 is not broken, since the crack detection line 20 surrounds the display area AA, the crack detection signal provided by the crack detection signal terminal 60 to the crack detection line 20 has a pressure drop loss during a transmission process of the crack detection signal. Then a voltage value of the signal received by the input terminal of the first crack detection switch 40 is smaller than a voltage value of the signal received by the input terminal of the second crack detection switch 41, and then brightness of a display area where the data lines corresponding to the first crack detection switch 40 are located is greater than brightness of a display area where the data lines corresponding to the second crack detection switch 41 are located. The display area where the data lines D corresponding to the first crack detection switch 40 connected to the crack detection line 20 are located is defined as a detection area, and the display area where the data lines D corresponding to the second crack detection switch 41 directly connected to the crack detection signal terminal 60 are located is defined as a standard area. By providing the second crack detection switch 41, the detection area and the standard area of the display area can be accurately distinguished at the same time when performing the crack detection, and after the detection area is determined, whether the crack detection line is broken is determined by a difference obtained by comparing a brightness of the detection area at the first moment and a brightness of the detection area at the second moment.

Figure 7:
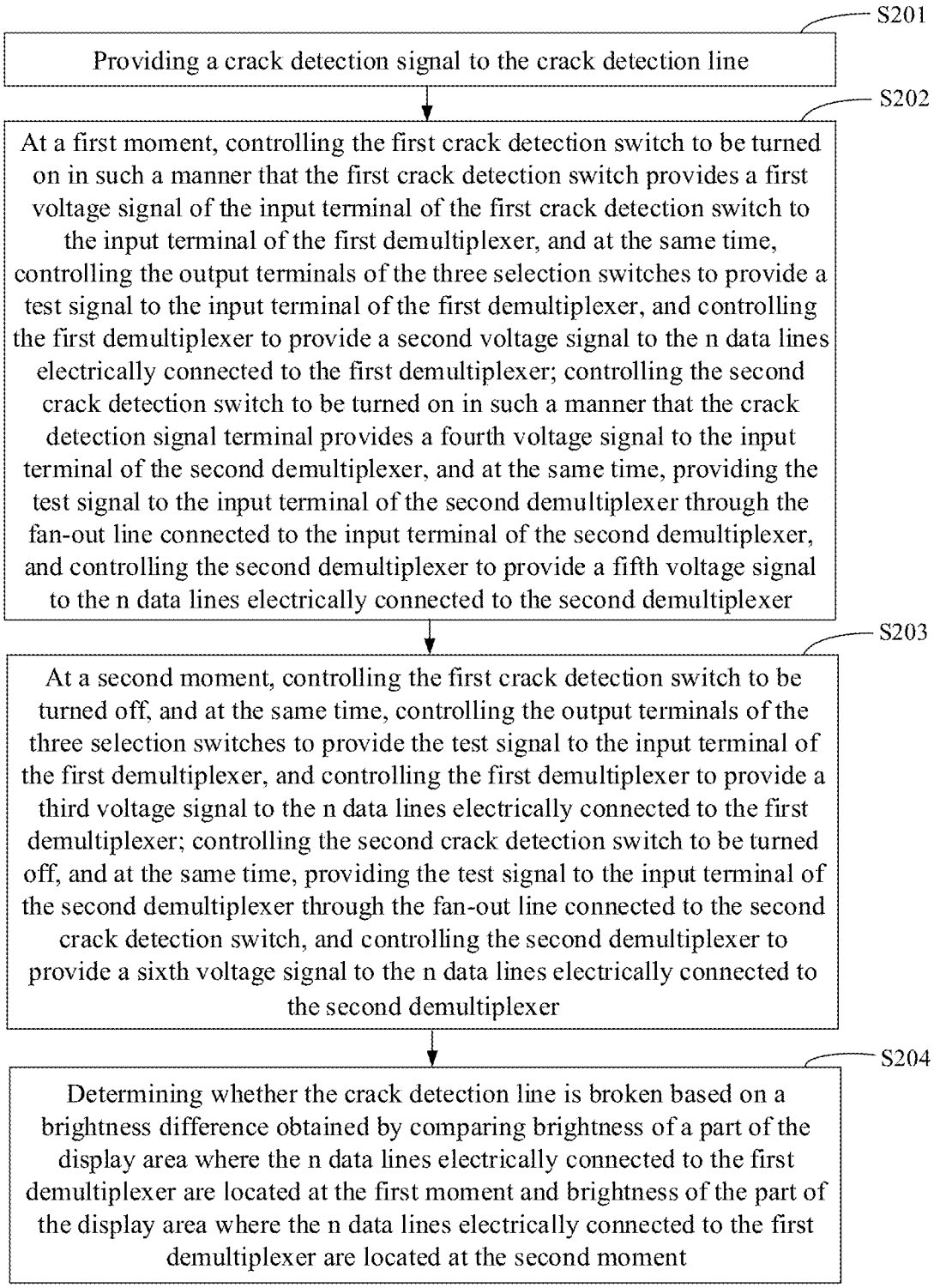
FIG. 7 is a flowchart of a method for detecting a display panel according to an embodiment of the present disclosure.

An embodiment of the present disclosure provides a method for detecting a display panel, which can be used to detect the display panel provided in the embodiment of FIG. 6. FIG. 7 is a flowchart of a method for detecting the display panel provided by an embodiment of the present disclosure.

As shown in FIG. 7, the detection method includes steps S201, S202, S203, and S204.

At step S201, a crack detection signal is provided to the crack detection line 20.

At step S202, at the first moment t1, the first crack detection switch 40 is controlled to be turned on, the first crack detection switch 40 provides a first voltage signal of the input terminal thereof to the input terminal of the first demultiplexer 31, and at the same time, a test signal is provided to the input terminal of the first demultiplexer 31 through the fan-out line 11, to control the first demultiplexer 31 to provide a second voltage signal to n data lines D electrically connected thereto; and the second crack detection switch 41 is controlled to be turned on, the crack detection signal terminal 60 provides a fourth voltage signal to the input terminal of the second demultiplexer 32, and at the same time, a test signal is provided to the input terminal of the second demultiplexer 32 through the fan-out line 11, to control the second demultiplexer 32 to provide a fifth voltage signal to n data lines electrically connected thereto. For example, at the first moment t1, the crack detection control signal line 50 is controlled to provide an effective level signal, to control both the first crack detection switch 40 and the second crack detection switch 41 to be turned on.

At step S203, at the second moment t2, the first crack detection switch 40 is controlled to be turned off, and at the same time, a test signal is provided to the input terminal of the first demultiplexer 31 through the fan-out line 11, and this test signal has the same magnitude as the test signal provided by the fan-out line 11 at the step S202; the first demultiplexer 31 is controlled to provide a third voltage signal to the n data lines D electrically connected thereto; and the second crack detection switch 41 is controlled to be turned off, and at the same time, a test signal is provided to the input terminal of the second demultiplexer 32 through the fan-out line 11, to control the second demultiplexer 32 to provide a sixth voltage signal to the n data lines electrically connected thereto. For example, at the second moment t2, the crack detection control signal line 50 is controlled to provide an ineffective level signal, to control both the first crack detection switch 40 and the second crack detection switch 41 to be turned off.

At step S204, whether the crack detection line 20 is broken is determined based on a brightness difference obtained by comparing a brightness of the display area where the n data lines D electrically connected to the first demultiplexer 31 are located at the first moment t1 and a brightness of the display area where the n data lines D electrically connected to the first demultiplexer 31 are located at the second moment t2.

In the two cases where the crack detection line 20 is broken and not broken, description of the voltage signal received by the input terminal of the first demultiplexer 31 at the first moment t1 and the second moment t2 can be referred to the description of the embodiment in FIG. 3, and it will not be repeated herein.

At the first moment t1, the second crack detection switch 41 is controlled to be turned on, then the input terminal of the second demultiplexer 32 simultaneously receives the voltage signal provided by the second crack detection switch 41 and a voltage signal (i.e., the test signal) provided by the fan-out line 11, and according to the description in the above embodiment in FIG. 3, a voltage value of the signal received by the input terminal of the second demultiplexer 32 is between a voltage value of the voltage signal provided by the second crack detection switch 41 and a voltage value of the voltage signal (i.e., the test signal) provided by the fan-out line 11. Moreover, since a voltage is generated on the crack detection wire, crack detection line 20 by the crack detection signal provided by the crack detection signal terminal 60 when the crack detection signal is transmitted on the crack detection line 20, when the crack detection line 20 is not broken, the voltage value of the voltage signal received by the input terminal of the first crack detection switch 40 is also smaller than the voltage value of the signal received by the input terminal of the second crack detection switch 41. Correspondingly, at the first moment, the brightness of the display area where the data lines connected to the first demultiplexer 31 are located is different from the brightness of the display area where the data lines connected to the second demultiplexer 32 are located, that is, there is a difference in brightness between the detection area and the standard area, thereby accurately distinguishing the detection area of the display panel. When the crack detection line 20 is broken, the input terminal of the first demultiplexer 31 only receives the test signal provided by the fan-out line 11, and when the voltage value of the test signal is smaller than the voltage value of the crack detection signal, the voltage value of the signal received by the input terminal of the first demultiplexer 31 is smaller than the voltage value of the signal received by the input terminal of the second demultiplexer 32, then the brightness of the display area where the data lines connected to the first demultiplexer 31 are located is greater than the brightness of the display area where the data lines connected to the second demultiplexer 32 are located, thereby accurately distinguishing the detection area of the display panel.

Similarly, at the second moment t2, both the first crack detection switch 40 and the second crack detection switch 41 are turned off, then the input terminal of the first demultiplexer 31 only receives the test signal provided by the fan-out line 11, the input terminal of the second demultiplexer 32 also only receives the test signal provided by the fan-out line 11, and the brightness of the display area where the data lines connected to the first demultiplexer 31 are located is approximately the same as the brightness of the display area where the data lines connected to the second demultiplexer 32 are located. There is no difference in brightness between the detection area and the standard area at this moment.

Figure 8:
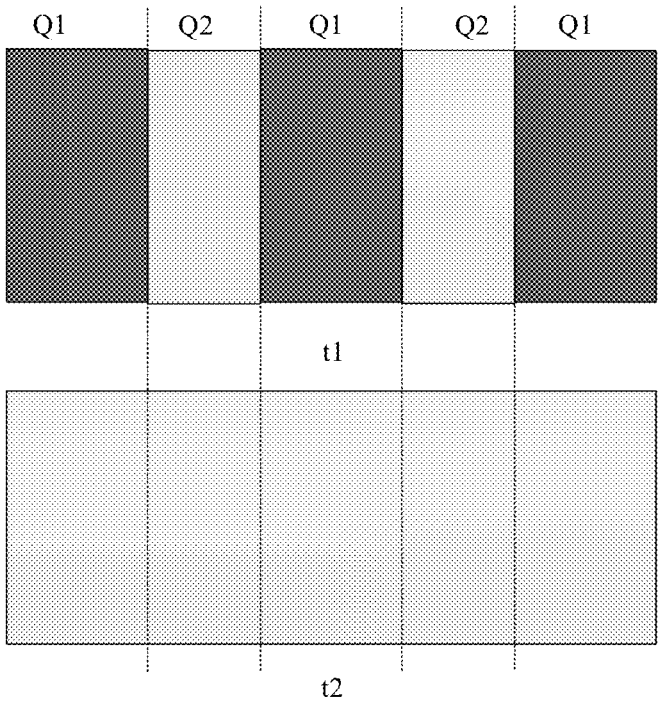
FIG. 8 is a third schematic diagram of brightness comparison of a partial display area of a display panel at a first moment and a second moment, according to an embodiment of the present disclosure.
Figure 9:
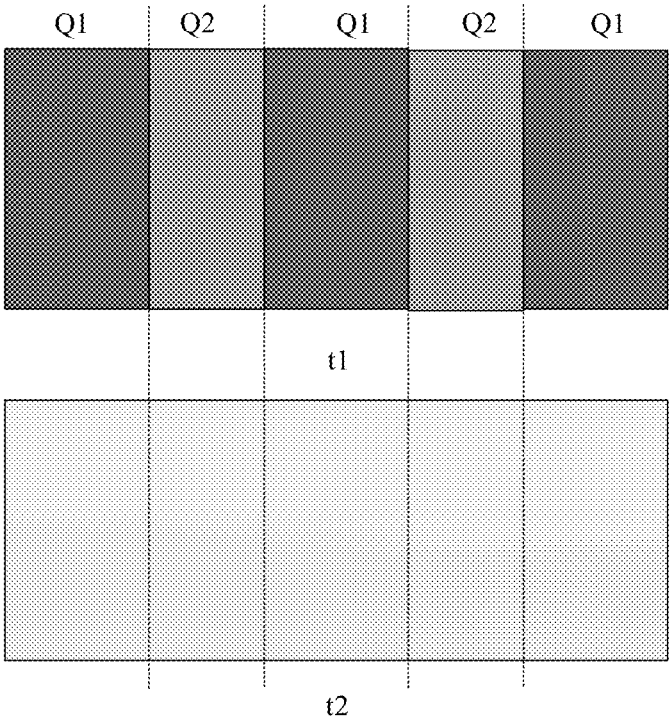
FIG. 9 is a fourth schematic diagram of brightness comparison of a partial display area of a display panel at a first moment and a second moment, according to an embodiment of the present disclosure.

The method for determining whether the crack detection line 20 is broken in the step S204 will be described below with an example. FIG. 8 is a third schematic diagram of the brightness comparison of the partial display area of the display panel at the first moment and the second moment, and FIG. 9 is a fourth schematic diagram of the brightness comparison of the partial display area of the display panel at the first moment and the second moment. Both an area Q1 and an area Q2 are shown in FIG. 8 and FIG. 9.

According to the above description, as shown in FIG. 8, the brightness of the area Q2 is greater than the brightness of the area Q1, then the area Q2 is the detection area, and the area Q1 is the standard area. The data line in the area Q2 is connected to the first demultiplexer 31, and the data line in the area Q1 is connected to the second demultiplexer 32. By comparing the brightness of the detection area at the first moment t1 and the second moment t2 to obtain a difference, it can be seen that in FIG. 8, the brightness of the area Q2 at the first moment t1 and the brightness of the area Q2 at the second moment t2 are basically the same, so it is determined that at the first moment t1, the input terminal of the first demultiplexer 31 also only receives the voltage signal (i.e., the test signal) provided thereto by the fan-out line 11, so it is determined that the crack detection line 20 is broken.

According to the above description, as shown in FIG. 9, the brightness of the area Q2 is greater than the brightness of the area Q1, then the area Q2 is the detection area, and the area Q1 is the standard area. By comparing the brightness of the detection area at the first moment t1 and the brightness of the detection area at the second moment t2 to obtain the difference, it can be seen that in FIG. 9, the brightness of the area Q2 at the first moment t1 is smaller than the brightness at the second moment t2, so that it can be determined that at the first moment t1, the input terminal of the first demultiplexer 31 simultaneously receives the voltage signal provided by the fan-out line 11 and the voltage signal (i.e., the test signal) provided by the first crack detection switch 40, so it is determined that the crack detection line 20 is not broken.

The display panel provided by the embodiment of the present disclosure can apply the method provided in the above steps S201 to S204 to determine whether the crack detection line is broken, to further determine whether there is a crack at the edge of the display panel, so as to detect defective products before they leave a factory.

In an embodiment, the display panel further includes a display test module, and the display test module is configured to test a display performance of the display panel. The display test module includes three test signal lines, three test control lines and multiple display test units, the display test unit includes three selection switches, and one test control line controls one selection switch. An embodiment of the present disclosure also provides a method for detecting a display panel including the display test module.

The input terminal of one demultiplexer is simultaneously connected to the output terminal of a display test unit, the output terminal of a crack detection switch (such as the first crack detection switch), and a fan-out line. In an embodiment, the control terminals of at least one of the distribution switches of the demultiplexer share the test control line with the selection switch of the display test unit, thereby reducing the number of the crack detection switches and the number of the control signal lines, and thus saving space of the non-display area. In both the display test phase and the crack detection phase of the display panel, the multiplexers are used to realize the detection, thereby increasing the integration degree of the display panel. After the detection is completed, the selection switch that shares the test control line with the distribution switch is disconnected from the test control line (to obtain the display panel shown in the embodiments of FIGS. 15 and 16), or the output terminal of the display test unit is disconnected from the input terminal of the demultiplexer (to obtain the display panel as shown in the embodiments of FIGS. 10 to 14), in order to avoid that the selection switch leaks a current to the input terminal of the multiplexer to affect the display when the display panel displays normally. The display panel and the method for detecting the display panel that are provided by an embodiments of the present disclosure will be described below with examples.

Figure 10:
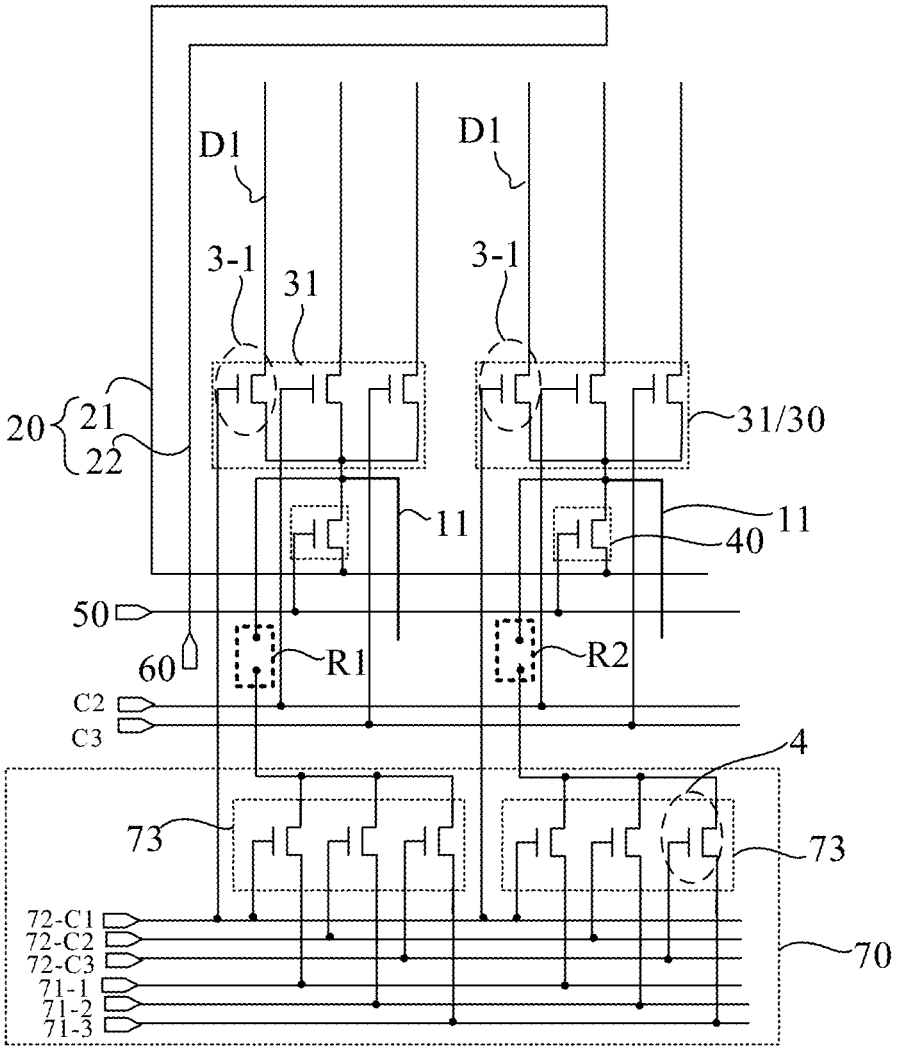
FIG. 10 is a schematic diagram of a circuit in a display panel provided by an embodiment of the present disclosure.

In an embodiment, the control terminal of at least one distribution switch of the demultiplexer is electrically connected to one test control line, that is, the at least one distribution switch and the one selection switch are connected to the same one test control line. FIG. 10 is a schematic diagram of a circuit of a display panel provided by an embodiment of the present disclosure. As shown in FIG. 10, the display panel further includes a display test module 70 provided in the non-display area BA, and the display test module 70 includes three test signal lines and three test control lines. The three test signal lines are a test signal line 71-1, a test signal line 71-2 and a test signal line 71-3, respectively. The test signal line 71-1, the test signal line 71-2 and the test signal line 71-3 can be respectively signal lines that respectively provide test signals to a red sub-pixel, a green sub-pixel, and a blue sub-pixel. The three test control lines are a first test control line 72-C1, a second test control line 72-C2, and a third test control line 72-C3, respectively.

The demultiplexer 30 includes at least one first distribution switch 3-1, and the input terminal of the first distribution switch 3-1 is electrically connected to the input terminal of the demultiplexer 30. The first demultiplexer 31 electrically connected to the first crack detection switch 40 is schematically shown in FIG. 10. The output terminal of the first distribution switch 3-1 is electrically connected to the first data line D1, and the first data line D1 is connected to multiple sub-pixels of the same color (i.e., a first color). In an embodiment, a plurality of sub-pixels connected to the first data line D1 form one pixel column, that is, a plurality of the sub-pixels in the same pixel column have the same color (i.e., a first color). In another embodiment, the multiple sub-pixels connected to the first data line D1 are some of the sub-pixels located in one pixel column, that is, at least two kinds of sub-pixels with different colors are located in the pixel column. The control terminal of the first distribution switch 3-1 is electrically connected to one test control line, i.e., the first test control line 72-C1 show in the drawing.

In the embodiment, the control terminal of one distribution switch of the demultiplexer is connected to the test control line of the display test module, and correspondingly, compared with the embodiment in FIG. 2, the number of the distribution control signal line for controlling the demultiplexer is reduced, which saves the space occupied by the non-display area.

In an embodiment, with continued reference to FIG. 10, the display test module 70 further includes a plurality of display test units 73, and the display test units 73 corresponds to the demultiplexers 30; one display test unit 73 includes three selection switches 4, a control terminal of the selection switch 4 is electrically connected to one test control line (one of the first test control line 72-C1, the second test control line 72-C2, and the third test control line 72-C3), and an input terminal of the selection switch 4 is electrically connected to one test signal line (one of the test signal line 71-1, the test signal line 71-2, and the test signal line 71-3).

The "correspondence" in the embodiment of the present disclosure means that the output terminal of one display test unit 73 corresponds to the input terminal of the demultiplexer 30, and it can be seen from the areas R1 and R2 in the drawing, that the output terminal of the display test unit 73 is disconnected from the input terminal of the demultiplexer 30. In an embodiment, when manufacturing of the display panel is completed, the output terminal of the display test unit 73 is electrically connected to the input terminal of the demultiplexer 30, while after detecting the display panel, the output terminal of the display test unit 73 is disconnected from the input terminal of the demultiplexer 30, in order to avoid that the selection switch 4 leaks a current to the input terminal of the demultiplexer 30 to affect the data signal provided to the data line D when the display panel displays normally.

Before the display panel provided in the embodiment of FIG. 10 leaves a factory, when the display test and the crack detection are performed on the display panel, the output terminal of the display test unit 73 and the input terminal of the demultiplexer 30 are connected.

When performing the display test on the display panel, the first crack detection switch 40 connected to the first demultiplexer 31 is controlled to be to be turned off, the display test signal is provided to the input terminal of the first demultiplexer 31 through the output terminal of the display test unit 73, and then the display test signal can be provided to the data line D connected to the first demultiplexer 31 by controlling the first demultiplexer 31, so as to realize the display test of the display panel.

When performing the crack detection on the display panel, the display test unit 73 is controlled to provide a test signal to the input terminal of the first demultiplexer 31 at the first moment, and at the same time, the first crack detection switch 40 is controlled to be turned on, when the crack detection line 20 is broken, the first crack detection switch 40 cannot provide a first voltage signal to the input terminal of the first demultiplexer 31 even after being turned on; when the crack detection line 20 is not broken, the first crack detection switch 40 simultaneously provides the first voltage signal to the input terminal of the first demultiplexer 31 after being turned on. Then at the second moment, the display test unit 73 is controlled to provide a test signal to the input terminal of the first demultiplexer 31, and at the same time, the first crack detection switch 40 is controlled to be turned off, then a situation where the input terminal of the first demultiplexer 31 receives the voltage signal at the second moment is the same as a situation where the input terminal of the first demultiplexer 31 receives the voltage signal at the first moment when the crack detection line 20 is broken. Then, by comparing the brightness of the display area where the data line connected to the first demultiplexer is located at the first moment and the brightness of the display area where the data line connected to the first demultiplexer is located at the second moment to obtain the difference, it can be determined whether the crack detection line is broken. Moreover, when the brightness of the display area where the data line connected by the first demultiplexer is located at the first moment is the same as the brightness of the display area where the data line connected by the first demultiplexer is located at the second moment, it is determined that the crack detection line is broken; when the brightness of the display area where the data line connected to the first demultiplexer is located at the first moment is different from the brightness of the display area where the data line connected to the first demultiplexer is located at the second moment, then it is determined that the crack detection line is not broken. Furthermore, it can be determined whether there is a crack at the edge of the display panel by a break condition of the crack detection line.

The display test and crack detection can be performed on the display panel provided in the embodiment of FIG. 10 before the display panel leaves a factory, and the demultiplexer connected to the fan-out line are used when performing the display test and the crack detection, and then the demultiplexer can be applied at different phases of the display panel, which increases the integration level of the display panel. When performing the crack detection, one crack detection switch can provide a crack detection signal to n data lines through a multiplexer, which reduces the number of the crack detection switches and saves space occupied by the non-display area. In addition, the control terminal of at least one first distribution switch of the multiplexer is connected to the test control line of the display test module, and one distribution control signal line for controlling the multiplexer is reduced, thereby reducing space occupied by the distribution control signal line and saving the space occupied by the non-display area, to realize a narrow bezel.

The method for detecting the display panel provided in the embodiment of FIG. 10 before the display panel leaves the factory will be described in detail in the following embodiment of the method.

Figure 11:
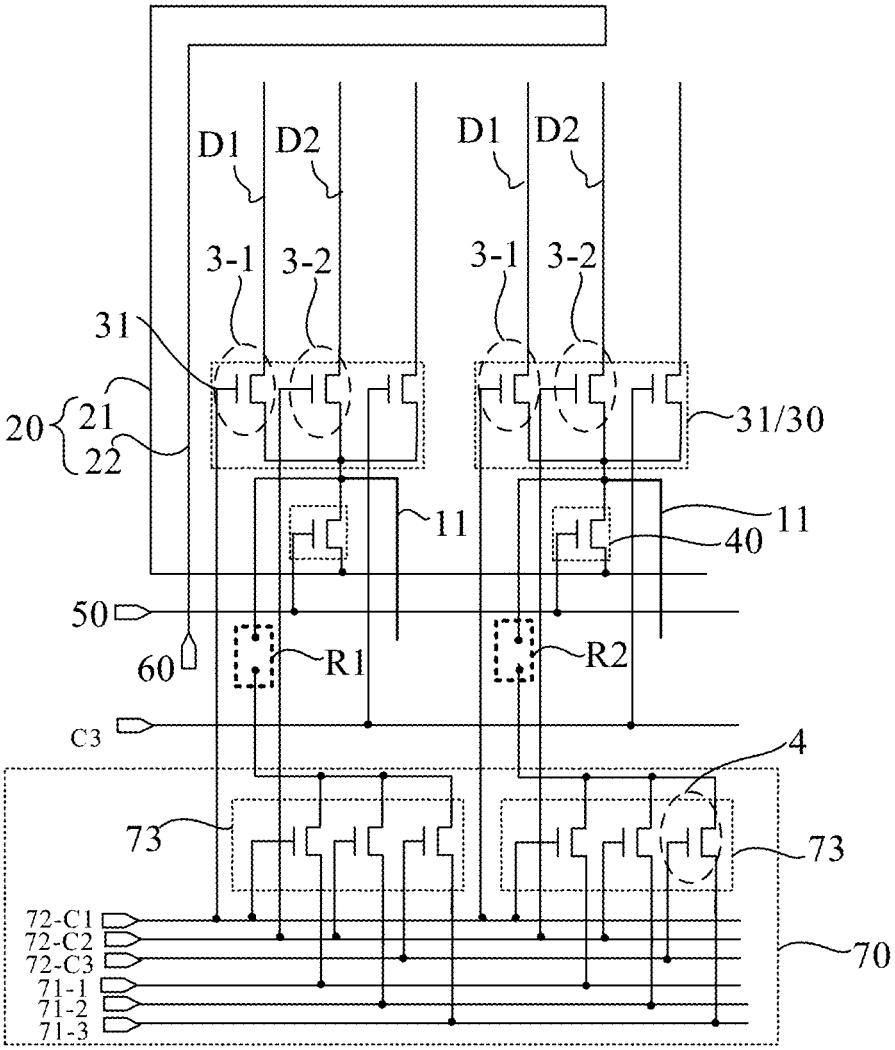
FIG. 11 is a schematic diagram of a circuit of a display panel provided by an embodiment of the present disclosure.

FIG. 11 is a schematic diagram of the circuit of the display panel provided by an embodiment of the present disclosure. As shown in FIG. 11, the demultiplexer 30 includes at least one second distribution switch 3-2, an input terminal of the second distribution switch 3-2 is electrically connected to the input terminal of the demultiplexer 30, an output terminal of the second distribution switch 3-2 is electrically connected to a second data line D2, the second data line D2 is connected to sub-pixels of the same color (i.e., a second color), and the second color is different from the first color. The second data line D2 can be connected to all sub-pixels in one pixel column, or connected to multiple sub-pixels located in one pixel column. The first demultiplexer 31 connected to the first crack detection switch 40 is shown in the drawing. The three test control lines include a first test control line 72-C1, a second test control line 72-C2, and a third test control line 72-C3. The control terminal of the first distribution switch 3-1 is electrically connected to the first test control line 72-C1, and the control terminal of the second distribution switch 3-2 is electrically connected to the second test control line 72-C2.

The embodiment of FIG. 11 also shows the area R1 and the area R2, and it can be seen that the output terminal of the display test unit 73 is disconnected from the input terminal of the demultiplexer 30. After manufacturing of the display panel is completed, the output terminal of the display test unit 73 is electrically connected to the input terminal of the demultiplexer 30, while after the display test and the crack detection that are performed on the display panel has completed, the output terminal of the display test unit 73 is disconnected from the input terminal of the demultiplexer 30, in order to avoid that the selection switch 4 leaks a current to the input terminal of the demultiplexer 30 to affect the data signal provided to the data line D when the display panel displays normally.

The display test and the crack detection can be performed on the display panel provided in the embodiment of FIG. 11 before the display panel leaves the factory, and the demultiplexer connected to the fan-out line is used when performing the display test and the crack detection, then the demultiplexer can be applied at different phases of the display panel, which increases the integration level of the display panel. When performing the crack detection, one crack detection switch can provide the crack detection signal to n data lines through the multiplexer, which reduces the number of the crack detection switches and saves space occupied by the non-display area. The control terminal of at least one first distribution switch of the multiplexer is connected to the first test control line of the display test module, and the control terminal of at least one second distribution switch is connected to the second test control line of the display test module, so that compared with the embodiment in FIG. 10, the number of the distribution control signal lines for controlling the demultiplexer can be reduced, and the space occupied by the non-display area can be saved. The method for detecting the display panel provided in the embodiment of FIG. 11 is performed before the display panel leaves the factory and will be described in detail in the following embodiments.

Figure 12:
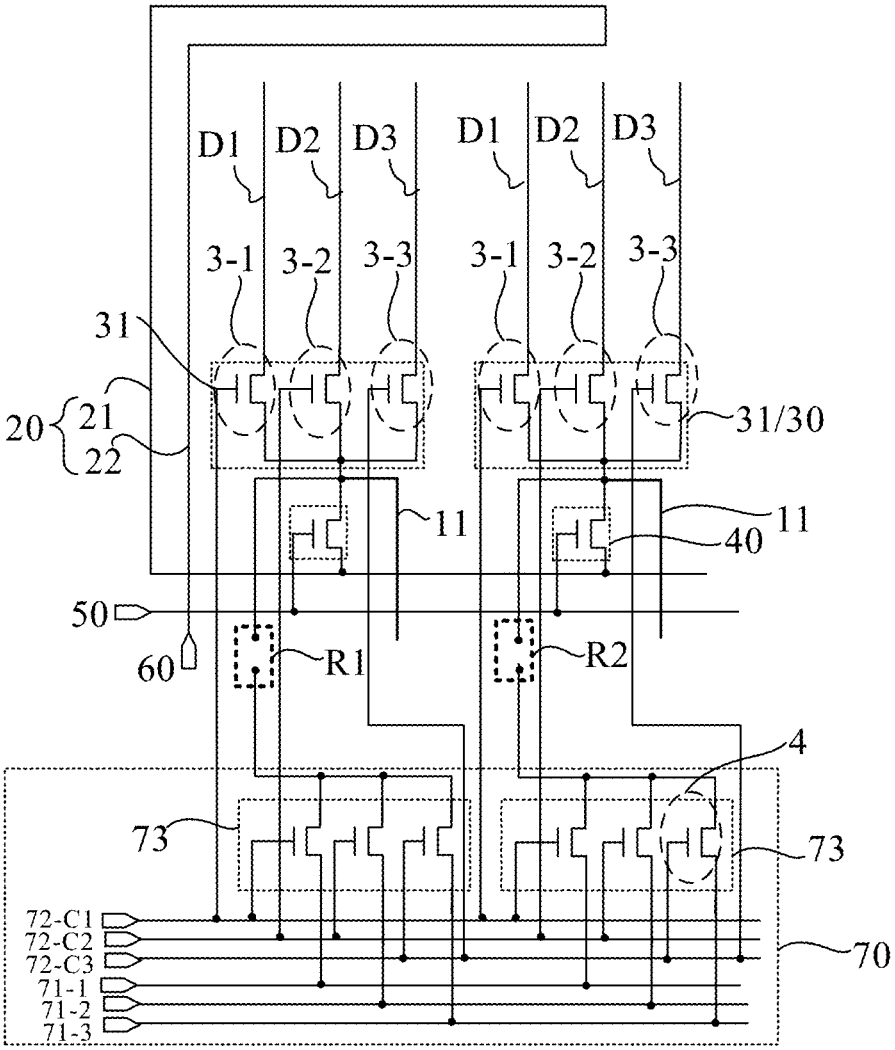
FIG. 12 is a schematic diagram of a circuit of a display panel provided by an embodiment of the present disclosure.

FIG. 12 is a schematic diagram of a circuit of the display panel provided by the embodiment of the present disclosure. As shown in FIG. 12, the demultiplexer 30 includes at least one third distribution switch 3-3, an input terminal of the third distribution switch 3-3 is electrically connected to the input terminal of the demultiplexer 30, an output terminal of the third distribution switch 3-3 is electrically connected to a third data line D3, the third data line D3 is connected to sub-pixels of the same color (i.e., a third color), and the first color, the second color, and the third color are respectively three different colors. The first demultiplexer 31 connected to the first crack detection switch 40 is shown in the drawing. The three test control lines include a first test control line 72-C1, a second test control line 72-C2, and a third test control line 72-C3. The control terminal of the first distribution switch 3-1 is electrically connected to the first test control line 72-C1, and the control terminal of the second distribution switch 3-2 is electrically connected to the second test control line 72-C2. The control terminal of the third distribution switch 3-3 is electrically connected to the third test control line 72-C3.

The embodiment of FIG. 12 also shows the area R1 and the area R2, and it can be seen that the output terminal of the display test unit 73 is disconnected from the input terminal of the demultiplexer 30. Specifically, after manufacturing of the display panel is completed, the output terminal of the display test unit 73 is electrically connected to the input terminal of the demultiplexer 30, while after the display test and the crack detection are performed on the display panel, the output terminal of the display test unit 73 is disconnected from the input terminal of the demultiplexer 30, in order to avoid that the selection switch 4 leaks a current to the input terminal of the demultiplexer 30 to affect the data signal provided to the data line D when the display panel displays normally.

The display test and the crack detection can be performed on the display panel provided in the embodiment of FIG. 12 before the display panel leaves the factory, and the demultiplexer connected to the fan-out line is used when performing both the display test and the crack detection, then the demultiplexer can be applied at different phases of the display panel, which increases the integration level of the display panel. When performing the crack detection, one crack detection switch can provide the crack detection signal to n data lines through the multiplexer, which reduces the number of the crack detection switches and saves space occupied by the non-display area. The control terminal of at least one first distribution switch of the multiplexer is connected to the first test control line of the display test module, the control terminal of at least one second distribution switch is connected to the second test control line of the display test module, and the control terminal of at least one third distribution switch is connected to the second test control line of the display test module, so that the number of the distribution control signal lines that control the demultiplexer can be reduced, and the space occupied by the non-display area can be further saved. The method for detecting the display panel provided in the embodiment of FIG. 11 is performed before the display panel leaves the factory and will be described in detail in the following embodiment of the detection method.

Figure 13:
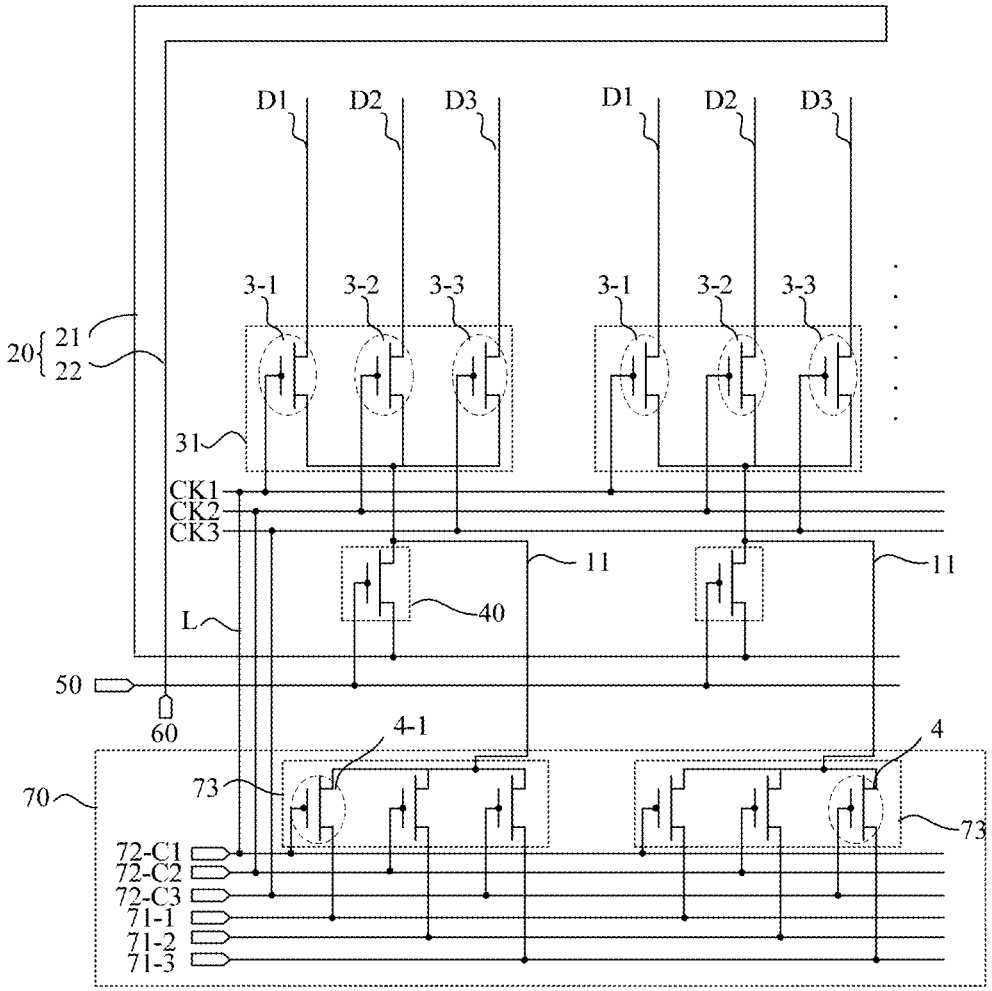
FIG. 13 is a schematic diagram of a circuit of a display panel provided by an embodiment of the present disclosure.

FIG. 13 is a schematic diagram of a circuit of the display panel provided by an embodiment of the present disclosure. As shown in FIG. 13, the demultiplexer 30 can further include a first distribution switch control signal line CK1, and the first distribution switch control signal line CK1 is electrically connected to the control terminal of the first distribution switch 3-1 and configured to control the first distribution switch 3-1 to be turned on and off. The first distribution switch control signal line CK1 is electrically connected to a connection line L, and the connection line L is electrically connected to the first test control line 72-C1, thereby electrically connecting the first distribution switch control signal line CK1 and the first test control line 72-C1, and a signal of the test signal line 71-1 can be transmitted to the corresponding data line 3-1 without separately providing a signal terminal (PAD, not shown in the drawing) for each control signal line, and the number of the signal terminal can be reduced, which optimizes the layout of the display panel and saves the space occupied by the non-display area.

If there is delay between a cutoff signal transmitted by the first distribution switch control signal line CK1 and a cutoff signal transmitted by the first test control line 72-C1, then when the first distribution switch 3-1 is turned off, the cut-off signal has not been received by the selection switch 4-1 corresponding to the first distribution switch 3-1 and this selection switch 4-1 is still in the on state, which will cause a difference in a voltage coupling amount of the data lines D1 electrically connected to the first distribution switch 3-1 at different positions. Since the signal terminal can simultaneously provide a control signal to the first distribution switch control signal line CK1 and the first test control line 72-C1 through the connection line L, the turn-on time and the turn-off time of the first distribution switch 3-1 and the selection switch 4-1 corresponding thereto (controlled by the same control signal) are close, such that a period between the time when the first distribution switch 3-1 receives the signal and the time when the selection switch 4-1 correspondingly electrically connected to the first distribution switch receives the signal, can be reduced, that is, the delay of the control signals received by different switches can be reduced, making voltage coupling amounts of the data lines D1 electrically connected to the first distribution switch 3-1 at different positions similar, thereby improving display uniformity of the display panel. In an embodiment, in addition to separately providing a signal line to connect the output terminal of the display test unit 73 with the input terminal of the demultiplexer 30, the output terminal of the display test unit 73 can be directly and electrically connect to the fan-out line 11, in order to connect the output terminal of the display test unit 73 and the input terminal of the demultiplexer 30, thereby simplifying wiring of the display panel.

Figure 14:
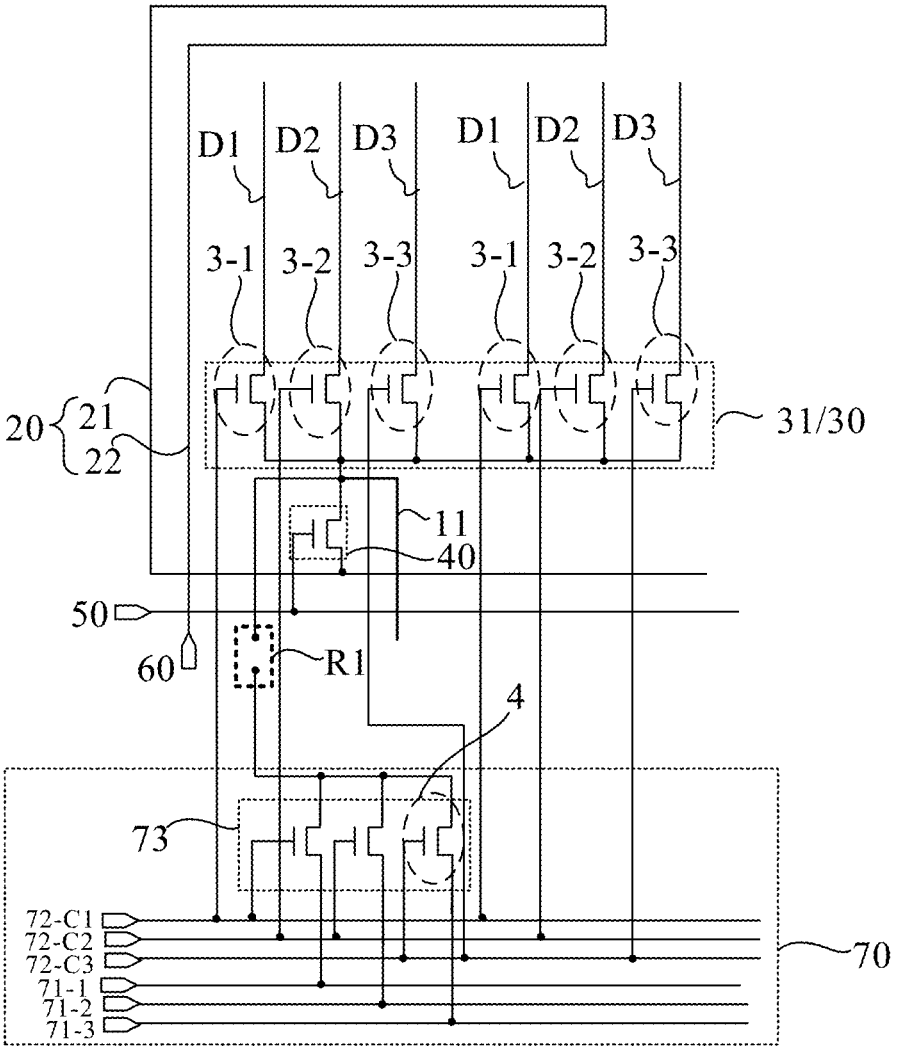
FIG. 14 is a schematic diagram of a circuit of a display panel provided by an embodiment of the present disclosure.

FIG. 14 is a schematic diagram of a circuit of the display panel provided by the embodiment of the present disclosure. As shown in FIG. 14, the demultiplexer 30 includes two first distribution switches 3-1, two second distribution switches 3-2, and two third distribution switches 3-3. One distribution switch is connected to one data line, that is, in this embodiment, the output terminal of one demultiplexer 30 is electrically connected to six data lines D. The control terminals of the two first distribution switches 3-1 are both electrically connected to the first test control line 72-C1, and the control terminals of the two second distribution switches 3-2 are both electrically connected to the second test control line 72-C2. The control terminals of the two third distribution switches 3-3 are both electrically connected to the third test control line 72-C3. The embodiment of FIG. 12 also shows the area R1, and it can be seen that the output terminal of the display test unit 73 is disconnected from the input terminal of the demultiplexer 30. After the display panel is manufactured, the output terminal of the display test unit 73 is electrically connected to the input terminal of the demultiplexer 30, while after performing the display test and the crack detection on the display panel, the output terminal of the display test unit 73 is disconnected from the input terminal of the demultiplexer 30, in order to avoid that the selection switch 4 leaks a current to the input terminal of the demultiplexer 30 to affect the data signal provided to the data line D when the display panel displays normally.

A difference between the embodiment of FIG. 14 and the embodiment of FIG. 12 lies in the number of the distribution switches of the demultiplexer 30, and in the embodiment of FIG. 14, the control terminals of the distribution switches of the demultiplexer 30 are all connected to the corresponding test control lines, and there is no need to additionally provide a control signal line for controlling the demultiplexer in the display panel, which can save the number of lines in the non-display area, thereby saving space in the non-display area.

In the embodiment of the present disclosure, the number of the distribution switches of the demultiplexer is not limited, and the number of the distribution switches is the same as the number of the data lines connected to the demultiplexer.

In another embodiment, the output terminal of one demultiplexer 30 is electrically connected to six data lines D, one demultiplexer includes six distribution switches, and only the control terminals of the three distribution switches are connected to three test control lines, while the remaining three distribution switches are still controlled by the control signal lines provided in the non-display area.

In another embodiment, the output terminal of one demultiplexer is electrically connected to nine data lines, one demultiplexer includes nine distribution switches, and the nine distribution switches include three first distribution switches, three second distribution switches and three third distribution switches.

The display panels shown in the above-mentioned embodiments of FIGS. 10 to 14 are the display panels obtained by disconnecting the output terminal of the display test unit from the input terminal of the demultiplexer after the detection is completed before leaving the factory. In some embodiments, before the display panel leaves the factory, after the display detection is completed, the control terminal of the selection switch of the display test unit is disconnected from the test control line, then in a solution where the control terminal of the distribution switch is connected to the test control line, when the display panel displays normally, the test control line can still control the distribution switch, and it can ensure that the selection switch is completely turned off, to avoid affecting the input terminal of the demultiplexer when receiving the voltage signal.

Figure 15:
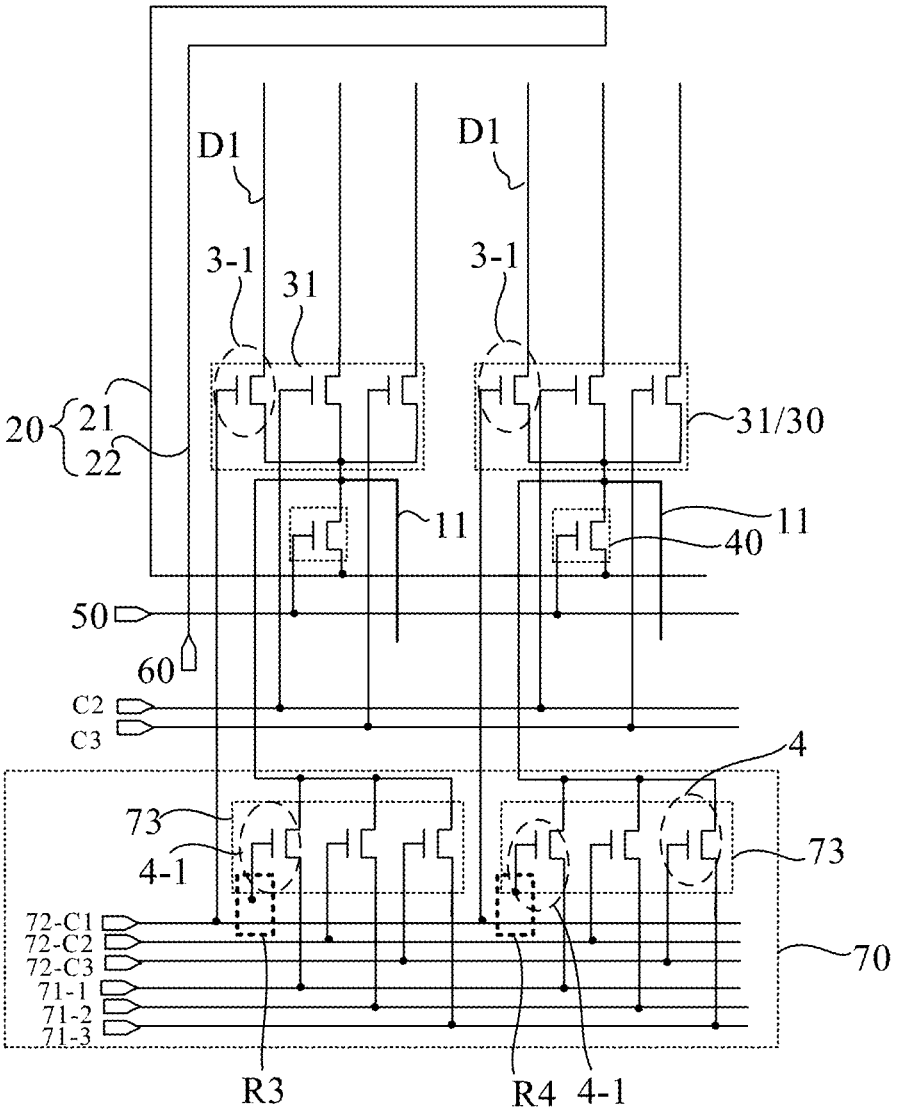
FIG. 15 is a schematic diagram of a circuit in a display panel provided by an embodiment of the present disclosure.

FIG. 15 is a schematic diagram of a circuit of a display panel according to an embodiment of the present disclosure. As shown in FIG. 15, the display panel further includes a display test module 70 provided in the non-display area, and the display test module 70 includes three test signal lines, three test control lines, and multiple display test units 73. The three test signal lines are a test signal line 71-1, a test signal line 71-2, and a test signal line 71-3, respectively, the three test control lines are a first test control line 72-C1, a second test control line 72-C2, and a third test control line 72-C3, respectively. One display test unit 73 includes three selection switches 4, the input terminal of the selection switch 4 is electrically connected to one test signal line, and the output terminals of the three selection switches 4 are electrically connected to the input terminal of the same demultiplexer 30. In the embodiment, the output terminal of the display test unit is electrically connected to the input terminal of the demultiplexer, and when the display test is performed on the display panel, the output terminal of the display test unit provides a display test signal to the corresponding data line through the demultiplexer. Moreover, as shown in the drawing, the input terminal of the first demultiplexer 31 is further connected to the output terminal of the first crack detection switch 40, and when the crack detection is performed on the display panel, the output terminal of the first crack detection switch 40 provides a crack detection signal to the corresponding data line through the first demultiplexer 31. The input terminal of the first demultiplexer 31 can be further electrically connected to the fan-out line 11, and in a case where the fan-out line 11 is a data signal line, when the display panel displays normally, the fan-out line 11 provides a data signal to the input terminal of the first demultiplexer 31, and the data signal can be provided to the corresponding data line through the first demultiplexer 31, to control the sub-pixels to emit light and display. In the embodiment, the demultiplexer can be applied at different phases of the display panel, which increases the integration level of the display panel. When performing the crack detection, one crack detection switch can provide the crack detection signal to n data lines through the multiplexer, which reduces the number of the crack detection switches and saves space occupied by the non-display area.

With continued reference to FIG. 15, the demultiplexer 30 includes at least one first distribution switch 3-1, an input terminal of the first distribution switch 3-1 is electrically connected to the input terminal of the demultiplexer 30, and a control terminal of the first distribution switch 3-1 is connected to one test control line, i.e., the first test control line 72-C1 shown in the drawing. The output terminal of the first distribution switch 3-1 is electrically connected to the first data line D1, and the first data line D1 is connected to sub-pixels of the same color (i.e., a first color). In an embodiment, a plurality of sub-pixels connected to the first data line D1 form a pixel column, that is, a plurality of the sub-pixels in the same pixel column have the same color. In another embodiment, the multiple sub-pixels connected to the first data line D are some of the sub-pixels located in one pixel column, that is, at least two kinds of sub-pixels with different colors are located in the pixel column. FIG. 15 also shows that the control terminal of the selection switch 4-1 corresponds to the first test control line 72-C1, and it can be seen from the area R3 and the area R4 in the drawing that the control terminal of the selection switch 4-1 is disconnected from the first test control line 72-C1.

After manufacturing the display panel, the control terminal of the selection switch 4-1 is electrically connected to the first test control line 72-C1, that is, both the control terminal of the selection switch 4-1 and the control terminal of the first distribution switch 3-1 are electrically connected to the first test control line 72-C1. When performing the display test and the crack detection on the display panel, the first test control line 72-C1 provides an effective level signal to control both the selection switch 4-1 and the first distribution switch 3-1 to be turned on, so that the number of the lines provided in the non-display area can be reduced, which saves space occupied by the non-display area. After performing the display test and crack detection on the display panel, the control terminal of the selection switch 4-1 is disconnected from the first test control line 72-C1, to prevent, when the display panel displays normally, the selection switch 4-1 from leaking a current to the input terminal of the demultiplexer 30 to affect the voltage signal received by the input terminal of the demultiplexer 30.

The display panel provided in this embodiment can complete the display test and crack detection before leaving the factory, and the demultiplexer connected to the fan-out line is used during both the display test and the crack detection, then the demultiplexer can be applied at different phases of the display panel, which increases the integration level of the display panel. Moreover, during the crack detection, one crack detection switch can provide the crack detection signal to n data lines through the multiplexer, which reduces the number of the crack detection switches and saves space of the non-display area. In addition, the control terminal of at least one first distribution switch of the multiplexer is connected with the test control line in the display test module, which is beneficial to further save the space of the non-display area. The detection method of the display panel in this embodiment will be described in the following specific embodiment of the detection method.

Figure 16:
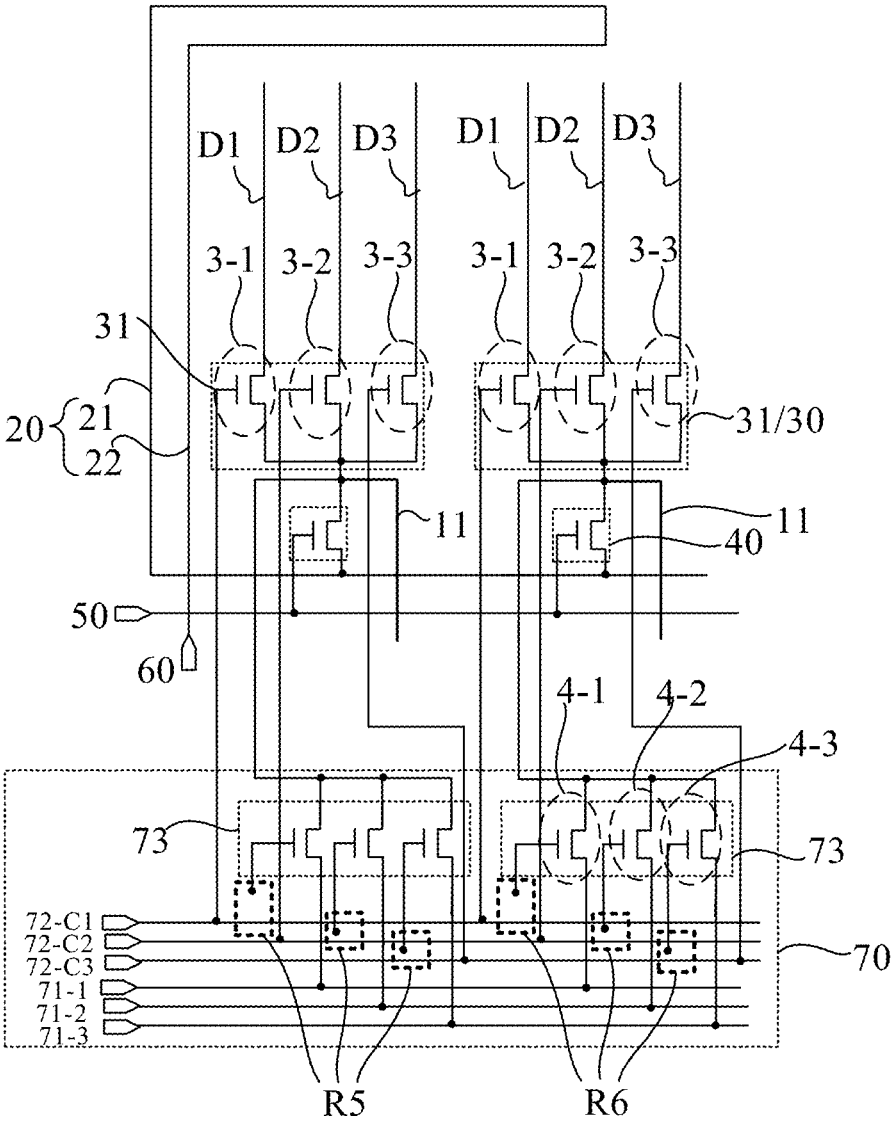
FIG. 16 is a schematic diagram of a circuit in a display panel provided by an embodiment of the present disclosure.

FIG. 16 is a schematic diagram of a circuit of a display panel according to an embodiment of the present disclosure. As shown in FIG. 16, the display test module 70 includes three test signal lines, three test control lines, and multiple display test units 73. The three test signal lines are a test signal line 71-1, a test signal line 71-2, and a test signal line 71-3, respectively. The three test control lines are a first test control line 72-C1, a second test control line 72-C2, and a third test control line 72-C3, respectively. One display test unit 73 includes three selection switches (which are selection switches 4-1, 4-2 and 4-3, respectively), the input terminal of the selection switch is electrically connected to one test signal line, and the output terminals of the three selection switches are electrically connected to the input terminal of the same demultiplexer 30. The demultiplexer 30 includes at least one first distribution switch 3-1, at least one second distribution switch 3-2, and at least one third distribution switch 3-3, and the input terminal of the first distribution switch 3-1 is electrically connected to the input terminal of the demultiplexer 30, the output terminal of the first distribution switch 3-1 is electrically connected to the first data line D1, the input terminal of the second distribution switch 3-2 is electrically connected to the input terminal of the demultiplexer 30, the output terminal of the second distribution switch 3-2 is electrically connected to the second data line D2, the input terminal of the third distribution switch 3-3 is electrically connected to the input terminal of the demultiplexer 30, and the output terminal of the third distribution switch 3-3 is electrically connected to the third data line D3. The second data line D2 is connected to sub-pixels of the same color (i.e., a second color), the third data line D3 is connected to sub-pixels of the same color (i.e., a third color), and the first color, the second color, and the third color are three different colors, respectively. The control terminal of the first distribution switch 3-1 is electrically connected to the first test control line 72-C1, and the control terminal of the second distribution switch 3-2 is electrically connected to the second test control line 72-C2. The control terminal of the third distribution switch 3-3 is electrically connected to the third test control line 72-C3.

FIG. 16 also shows that the control terminal of the selection switch 4-1 corresponds to the first test control line 72-C1, the control terminal of the selection switch 4-2 corresponds to the second test control line 72-C2, and the control terminal of the selection switch 4-3 corresponds to the third test control line 72-C3. It can be seen from the area R5 and the area R6 in the drawing that the control terminal of the selection switch 4-1 is disconnected from the first test control line 72-C1, the control terminal of the selection switch 4-2 is disconnected from the second test control line 72-C2, and the control terminal of the selection switch 4-3 is disconnected from the third test control line 72-C3.

Actually, after manufacturing the display panel, the control terminal of the selection switch 4-1 is electrically connected to the first test control line 72-C1, the control terminal of the selection switch 4-2 is electrically connected to the second test control line 72-C2, and the control terminal of the selection switch 4-3 is electrically connected to the third test control line 72-C3. That is, the distribution switch of the demultiplexer 30 and the corresponding selection switch of the display test unit 73 share the test control line. When the display test and crack detection are performed on the display panel, one test control line provides an effective level signal to control both the conduction of the selection switch and the conduction of the corresponding distribution switch, so that the number of lines provided in the non-display area can be reduced, which saves space occupied by the non-display area. After the display test and the crack detection are performed on the display panel, the control terminal of the selection switch is disconnected from the test control line, in order to prevent, when the display panel displays normally, the selection switch from leaking a current to the input terminal of the demultiplexer 30 to affect the voltage signal received by the input terminal of the demultiplexer 30.

The display test and the crack detection can be performed on the display panel before leaving the factory, and the demultiplexer connected to the fan-out line is used when performing the display test and the crack detection, then the demultiplexer can be applied at different phases of the display panel, which increases the integration level of the display panel. When performing the crack detection, one crack detection switch can provide the crack detection signal to n data lines through the multiplexer, which reduces the number of the crack detection switches and saves space occupied by the non-display area. In addition, the control terminal of the distribution switch of the multiplexer is connected to the test control line of the display test module, which saves the space occupied by the non-display area. The method for detecting the display panel in this embodiment will be described in the following embodiments.

In the display panel, division of modules to which various lines belong is not unique. In the embodiment of FIG. 16, the three test control lines are divided into the display test module, and, the three test control lines can also be classified as control lines of the demultiplexer. It can also be understood that, before the display panel leaves the factory, the control terminal of the selection switch of the display test unit is connected to the control line of the multiplexer, to realize that the control terminal of the selection switch and the control terminal of the distribution switch of the demultiplexer share the control line. Division of the test control lines in the embodiments of FIGS. 10 to 14 can also be understood with reference to this description.

In addition, from the illustration and description of the embodiment of FIG. 15, it can be understood that before the display test and the crack detection are completed, the control terminal of one selection switch of the display test unit and the control terminal of the first distribution switch of the demultiplexer are connected to the same test control line. From the illustration and description of the embodiment of FIG. 16, it can be understood that before the display panel completes the display test and the crack detection are completed, the control terminals of the three selection switches of the display test unit and the control terminals of the three distribution switches of the multiplexer share the test control line. In another embodiment, before the display test and the crack detection are completed, the control terminals of the two selection switches of the display test unit and the control terminals of the two kinds of distribution switches of the demultiplexer share the test control line, and after the display test and the crack detection are completed, the control terminal of the selection switch is disconnected from the corresponding test control line.

The above-mentioned embodiments of FIG. 15 and FIG. 16 are both illustrated that the output terminal of one demultiplexer is connected to three data lines. In some embodiments, the output terminal of one demultiplexer is connected to six data lines. In other embodiments, the output terminal of one demultiplexer are connected to twelve data lines. Different implementation manners can be understood with reference to the above-mentioned embodiments of FIG. 15 and FIG. 16.

In some embodiments, on the basis of the display panel provided in the above-mentioned embodiments of FIG. 10 to FIG. 14, the display panel further includes a second crack detection switch provided in the non-display area, the multiple demultiplexers further include a second demultiplexer, a control terminal of the second crack detection switch is electrically connected to the crack detection control signal line, an input terminal of the second crack detection switch is electrically connected to the crack detection signal terminal, an output terminal of the second crack detection switch is electrically connected to an input terminal of the second demultiplexer, the input terminal of the second demultiplexer is also connected to one fan-out line, one second demultiplexer corresponds to one display test unit, and the output terminal of the display test unit is disconnected from the input terminal of the second demultiplexer. In an embodiment, the configuration of the second demultiplexer is the same as that of the first demultiplexer. Taking the display panel provided in the embodiment of FIG. 10 as an example, the control terminal of at least one first distribution switch of the first demultiplexer is connected to one test control line, correspondingly, in the display panel including the second demultiplexer, the control terminal of the first distribution switch of the second demultiplexer is also connected to one test control line.

In some embodiments, on the basis of the display panel provided in the above-mentioned embodiments of FIG. 15 and FIG. 16, the display panel also includes a second crack detection switch provided in the non-display area, the multiple demultiplexers further include a second demultiplexer, a control terminal of the second crack detection switch is electrically connected to the crack detection control signal line, an input terminal of the second crack detection switch is electrically connected to the crack detection signal terminal, an output terminal of the second crack detection switch is electrically connected to an input terminal of the second demultiplexer, the input terminal of the second demultiplexer is further connected to one fan-out line, and the input terminal of the second demultiplexer is further connected to the output terminal of the display test unit. In an embodiment, the second demultiplexer has the same configuration as the first demultiplexer, the configuration of the display test unit connected to the second demultiplexer is the same as the configuration of the display test unit connected to the first demultiplexer. Taking the display panel provided in the embodiment of FIG. 15 as an example, the control terminal of at least one first distribution switch 3-1 of the first demultiplexer 31 is connected to the first test control line 72-C1, and correspondingly, in the display panel including the second demultiplexer, the control terminal of the first distribution switch of the second demultiplexer is also connected to one test control line. The input terminal of the selection switch 4-1 of the display test unit 73 connected to the first demultiplexer 31 is disconnected from the first test control line 72-C1, and correspondingly, in the display panel including the second demultiplexer, the input terminal of the selection switch of the display test unit connected to the second demultiplexer is also disconnected from the first test control line.

An embodiment of the present disclosure further provides a n method for detecting a display panel, the general structure of the display panel can be referred to the schematic diagram in FIG. 1 above, the display panel includes a display area AA and a non-display area BA at least partially surrounding the display area AA. The non-display area BA includes a fan-out area 10, and the display panel includes a plurality of fan-out lines 11 provided in the fan-out area 10, and multiple data lines D provided in the display area AA. The display panel includes a crack detection line 20, a plurality of demultiplexers 30, a first crack detection switch 40, and a crack detection control signal line 50 that are provided in the non-display area BA. The crack detection line 20 surrounds the display area AA, and the crack detection line 20 includes a first detection sub-line 21 and a second detection sub-line 22 connected, the first detection sub-line 21 extends along a first direction x, and the second detection sub-line 22 extends along the first direction x. Along a second direction y, there is a gap between an orthographic projection of the first detection sub-line 21 on a light-exiting surface of the display panel and an orthographic projection of the second detection sub-line 22 on the light-exiting surface of the display panel. It can be seen from the drawing that the first detection sub-line 21 and the second detection sub-line 22 are located on the same side of the display area AA, the first detection sub-line 21 is connected to an input terminal of the first crack detection switch 40, and the second detection sub-line 22 is connected to a crack detection signal terminal 60. The first direction x and the second direction y intersect.

An output terminal of the demultiplexer 30 is electrically connected to n data lines D, where n is a positive integer and $n \geq 2$, and the demultiplexer 30 is configured to provide the signal of the input terminal of the demultiplexer 30 to the corresponding data line D under control of a signal of a control terminal of the demultiplexer 30. The multiple demultiplexers 30 include a first demultiplexer 31, an input terminal of the first demultiplexer 31 is connected to an output terminal of the first crack detection switch 40 and one fan-out line 11, a control terminal of the first crack detection switch 40 is electrically connected to the crack detection control signal line 50.

Figure 17:
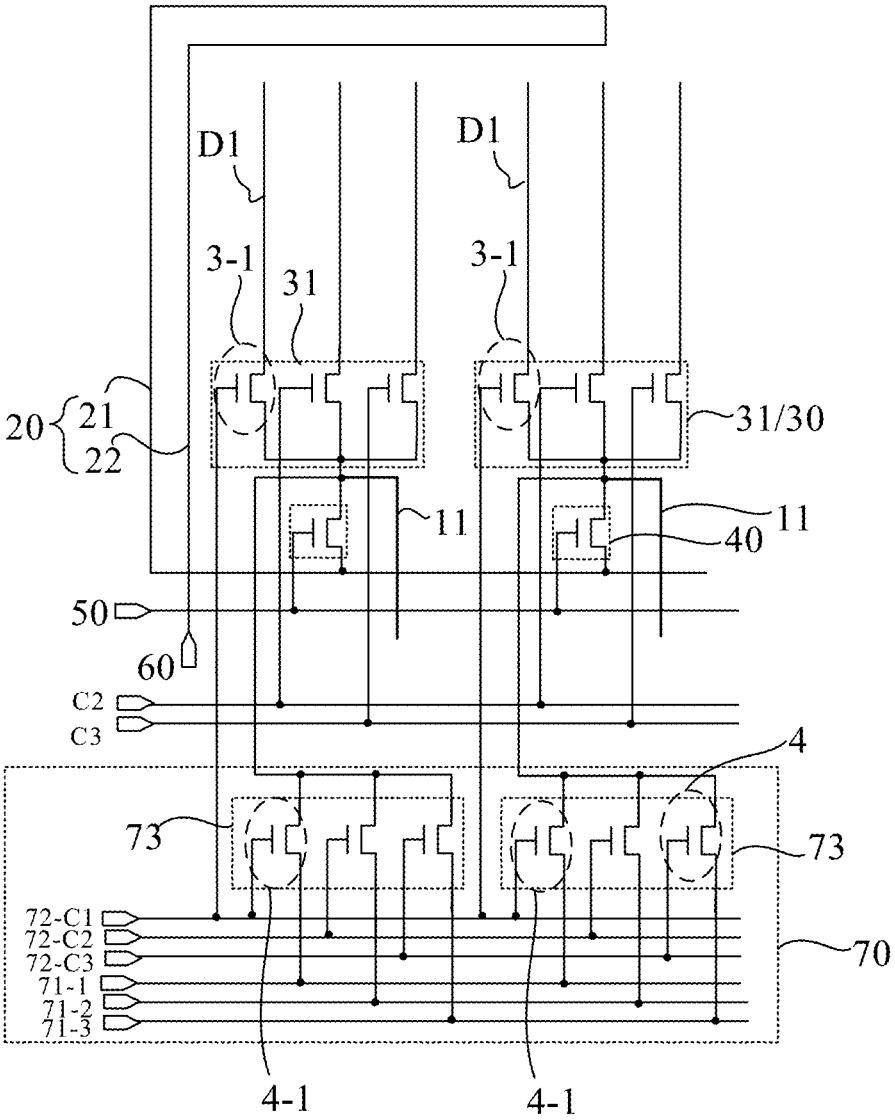
FIG. 17 is a schematic diagram of a circuit of a display panel to which a detection method can be applied according to an embodiment of the present disclosure.

FIG. 17 is a schematic diagram of a circuit structure of a display panel to which the method provided by an embodiment of the present disclosure can be applied, the structure of the display panel to which the method provided by the embodiment of the present disclosure can be applied can be understood with reference to FIG. 1 and FIG. 17.

As shown in FIG. 17, the non-display area BA further includes a display test module 70, the display test module 70 includes three test signal lines, three test control lines, and multiple display test units 73. The three test signal lines are a test signal line 71-1, a test signal line 71-2, and a test signal line 71-3, respectively. The three test control lines are a first test control line 72-C1, a second test control line 72-C2, and a third test control line 72-C3. One display test unit 73 includes at least three selection switches 4, a control terminal of the selection switch 4 is electrically connected to one test control line, an input terminal of the selection switch 4 is electrically connected to one test signal line, and the output terminals of the at least three selection switches 4 are electrically connected to the input terminal of one same demultiplexer 30.

The demultiplexer 30 includes at least one first distribution switch 3-1, an input terminal of the first distribution switch 3-1 is electrically connected to the input terminal of the demultiplexer 30, an output terminal of the first distribution switch 3-1 is electrically connected to the first data line D1, and the first data line D1 is connected to sub-pixels of the same color (i.e., a first color). The drawing shows that one demultiplexer includes three distribution switches including the first distribution switch 3-1. A control terminal of the first distribution switch 3-1 is electrically connected to one test control line, and the drawing shows that the control terminal of the first distribution switch 3-1 is electrically connected to the first test control line 72-C1. The control terminals of the other two distribution switches are respectively connected to the distribution control signal line C2 and the distribution control signal line C3.

Figure 18:
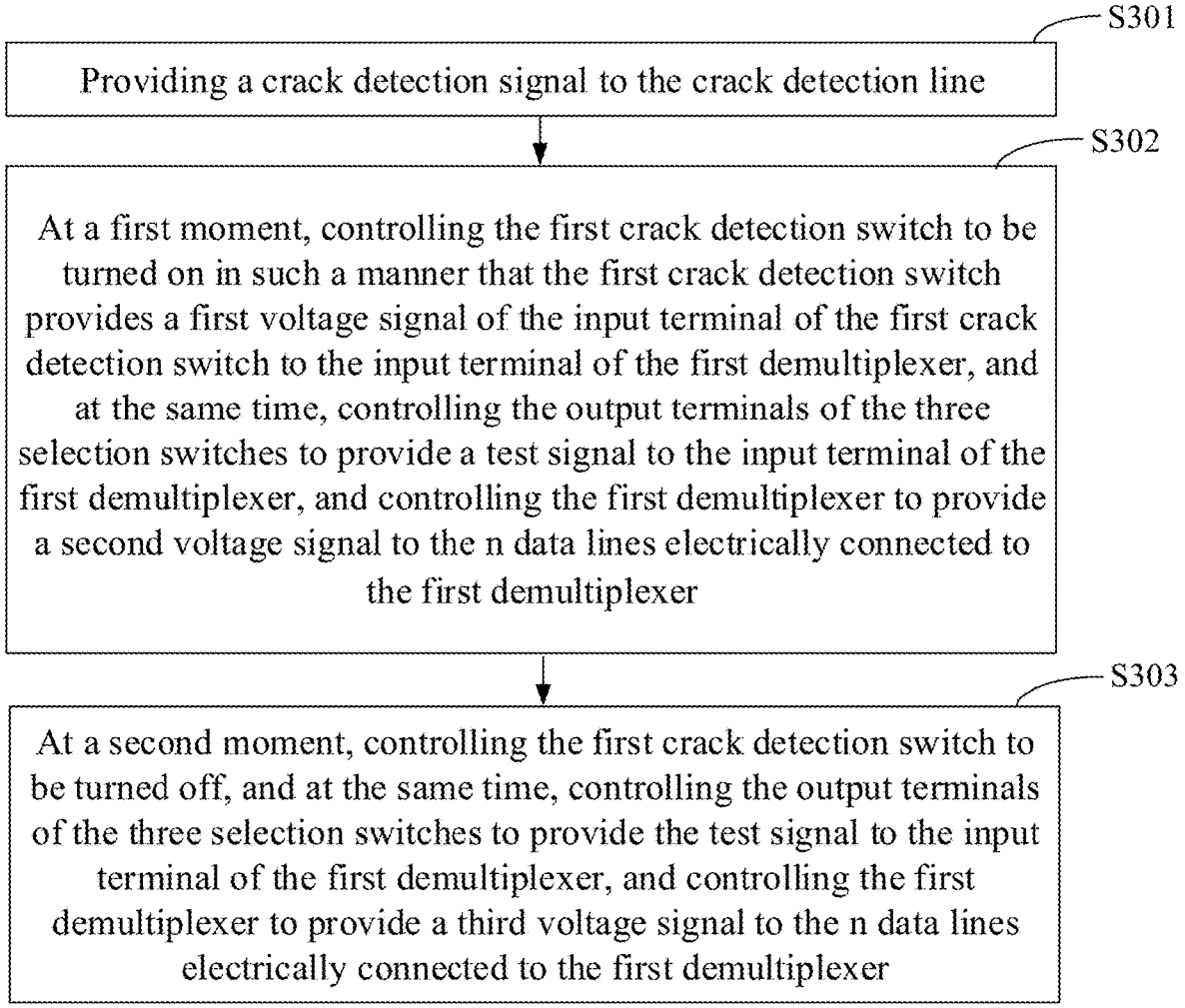
FIG. 18 is a flowchart of a method for detecting a display panel according to an embodiment of the present disclosure.

The display panel provided in the embodiment of FIG. 17 is the display panel provided in the embodiments of FIGS. 10 and 15 before the detection is completed in a factory. That is, the display panels provided by the embodiments of FIG. 10 and FIG. 15 can be detected in the factory using following methods. FIG. 18 is a flowchart of a method for detecting a display panel provided by an embodiment of the present disclosure. As shown in FIG. 18, the detection method includes steps S301, S302, and S303.

At step S301, a crack detection signal is provided to the crack detection line 20. Specifically, the crack detection signal is provided to the crack detection line 20 through the crack detection signal terminal 60. When the crack detection line 20 is not broken, the crack detection signal can be provided to the input terminal of the first crack detection switch 40 after being transmitted through the second detection sub-line 22 and the first detection sub-line 21. When the crack detection line 20 is broken, the crack detection signal cannot be provided to the input terminal of the first crack detection switch 40 after being transmitted through the second detection sub-line 22 and the first detection sub-line 21, that is, when the crack detection line 20 is broken, the input terminal of the first crack detection switch 40 cannot receive the crack detection signal.

At step S302, at a first moment, the first crack detection switch 40 is controlled to be turned on, the first crack detection switch 40 provides a first voltage signal of the input terminal of the first crack detection switch 40 to the input terminal of the first demultiplexer 31, and at the same time, the output terminal of the selection switch 4 is controlled to provide a test signal to the input terminal of the first demultiplexer 31, to control the first demultiplexer 31 to respectively provide a second voltage signal to the n data lines D electrically connected to the first demultiplexer 31.

It can be understood with reference to the description of the step S102 in the embodiment of FIG. 3, in the step S302, when the crack detection line 20 is not broken, the input terminal of the first demultiplexer 31 simultaneously receives the voltage signal provided thereto by the first crack detection switch 40 and the voltage signal provided thereto by the display test unit 73, and a voltage value of the voltage signal received by the input terminal of the first demultiplexer 31 is between a voltage value of the test signal (provided by the fan-out line 11) and a voltage value of the crack detection signal (provided by the output terminal of the first crack detection switch 40). When the crack detection line 20 is broken, the input terminal of the first crack detection switch 40 cannot receive the crack detection signal, then the input terminal of the first demultiplexer 31 only receives the voltage signal (i.e., the test signal) provided by the display test unit 73.

In other words, when the crack detection line 20 is in unbroken and broken states, at the first moment, the voltage signals received by the input terminal of the first demultiplexer 31 are different, thus the voltage signals provided to the corresponding data line D are different in magnitude, then correspondingly, brightness of the sub-pixels connected to the data line D is different. Then, when the crack detection line 20 is in unbroken and broken states, at the first moment, there is difference in the brightness of the display area where the n data lines D connected to the first demultiplexer 31 are located.

At step S303, at a second moment, the first crack detection switch 40 is controlled to be turned off, and at the same time, the output terminal of the selection switch 4 is controlled to provide a test signal to the input terminal of the first demultiplexer 31, to control the first demultiplexer 31 to respectively provide a third voltage signal to the n data lines D electrically connected thereto.

With reference to the description of step S103 in the above embodiment of FIG. 3, it can be understood that in step S303, regardless of whether the crack detection line 20 is broken, at the second moment, the brightness of the display area where the n data lines D electrically connected to the first demultiplexer 31 are located does not change, then the brightness of the display area where the n data lines D electrically connected to the first demultiplexer 31 are located at the second moment can be used as a comparative example, and by comparing the first moment with the second moment, a brightness difference of the display area where the n data lines D are located can be used to determine whether the corresponding crack detection line 20 is broken.

When the brightness of the display area where the n data lines electrically connected to the first demultiplexer are located is different at the first moment and the second moment, it indicates that at the first moment, the input terminal of the first demultiplexer 31 simultaneously receives the voltage signal provided by the display test unit 73 and the voltage signal provided by the first crack detection switch 40, so that it can be determined that the crack detection line 20 is not broken, and it can be further determined that there is no crack at the edge of the display panel. When the brightness of the display area where the n data lines electrically connected to the first demultiplexer are located is the same at the first moment and the second moment, it indicates that at the first moment, the input terminal of the first demultiplexer 31 only receives the voltage signal provided by the display test unit 73, so that it can be determined that the crack detection line 20 is broken, and it can be further determined that there is a crack at the edge of the display panel.

Through the method provided in the above steps S301 to S303, whether the crack detection line in the display panel is broken can be detected, to further determine whether there is a crack at the edge of the display panel, so as to detect defective products before leaving the factory.

In an embodiment, in the display panel to be detected, the control terminal of the first distribution switch 3-1 of the demultiplexer and the control terminal of one selection switch 4 (the selection switch 4-1 is shown in the drawing) of the display test unit 73 are connected to the same first test control line 72-C1.

In an embodiment, the above step S302 includes: providing, by the test control line, an effective level signal to control both the selection switch connected thereto and the first distribution switch connected thereto to be turned on, to cause the output terminal of the selection switch to provide a test signal to the input terminal of the first demultiplexer, and at the same time, to cause the output terminal of the first distribution switch to provide the second voltage signal to the data line connected thereto; and the step S303 includes: providing, by the test control line, an effective level signal to control the selection switch connected thereto and the first distribution switch connected thereto to be turned on, to cause the output terminal of the selection switch to provide a test signal to the input terminal of the first demultiplexer, and at the same time, to cause the output terminal of the first distribution switch to provide the third voltage signal to the data line connected thereto.

That is, at step S302 and step S303, when the test control line 72-C1 provides an effective level signal, it can simultaneously control the selection switch 4-1 and the first distribution switch 3-1 to be turned on, then the test signal line 71-1 provides the test signal to the input terminal of the selection switch 4-1, the selection switch 4-1 is turned on, the selection switch 4-1 provides the test signal to the input terminal of the first distribution switch 3-1, the first distribution switch 3-1 is in a conduction state, then the first distribution switch 3-1 provides the test signal to the first data line D1, the first data line D1 provides a test signal to a plurality of sub-pixels connected thereto, to drive the sub-pixels to emit light. In other words, in the process of detecting the display panel, the first test control line 72-C1 can simultaneously control the first distribution switch 3-1 and the selection switch 4, which reduces the number of the control signal lines of the display panel and saves space occupied by the non-display area.

Figure 19:
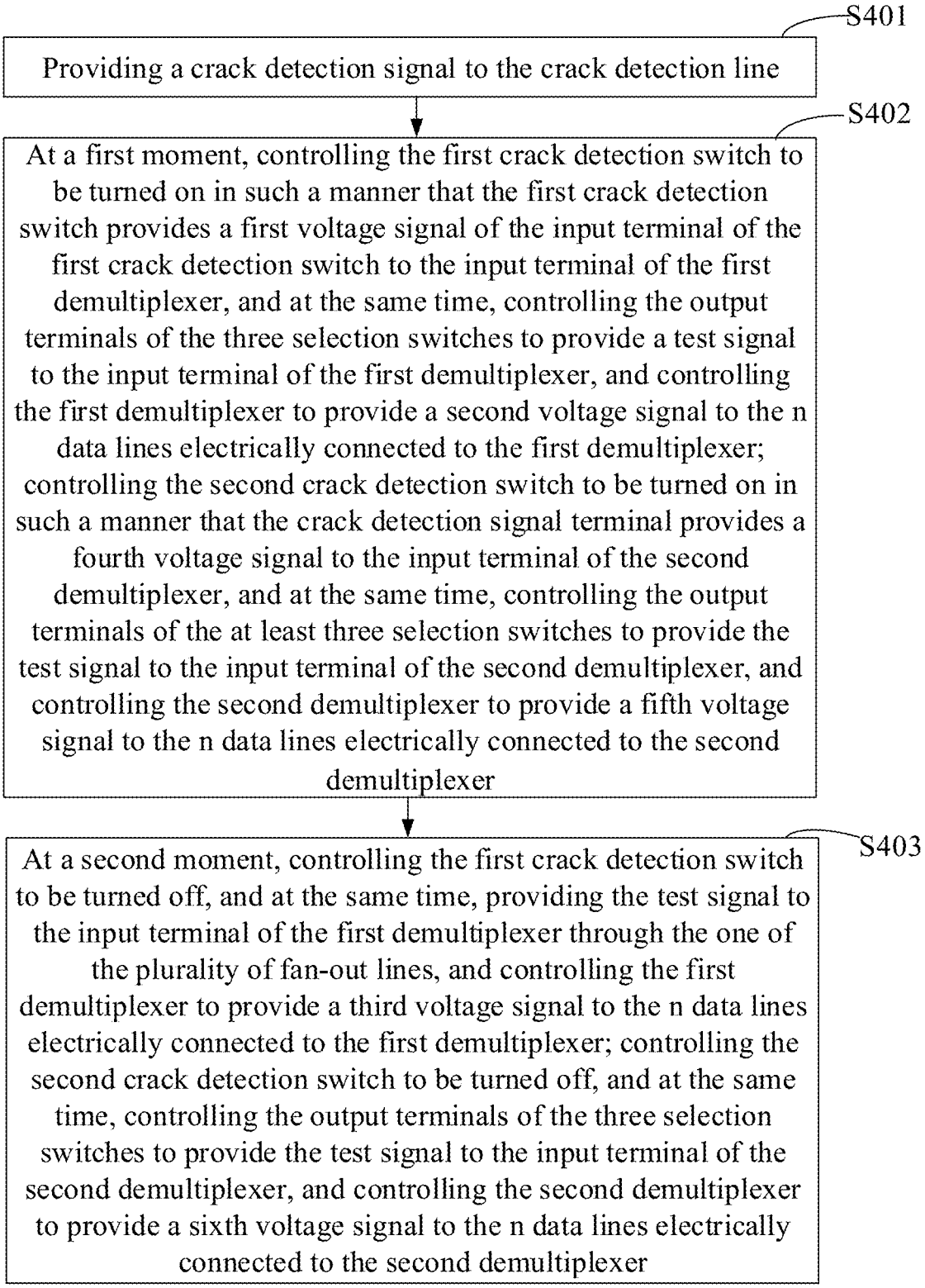
FIG. 19 is a flowchart of a method for detecting a display panel provided by an embodiment of the present disclosure.
Figure 20:
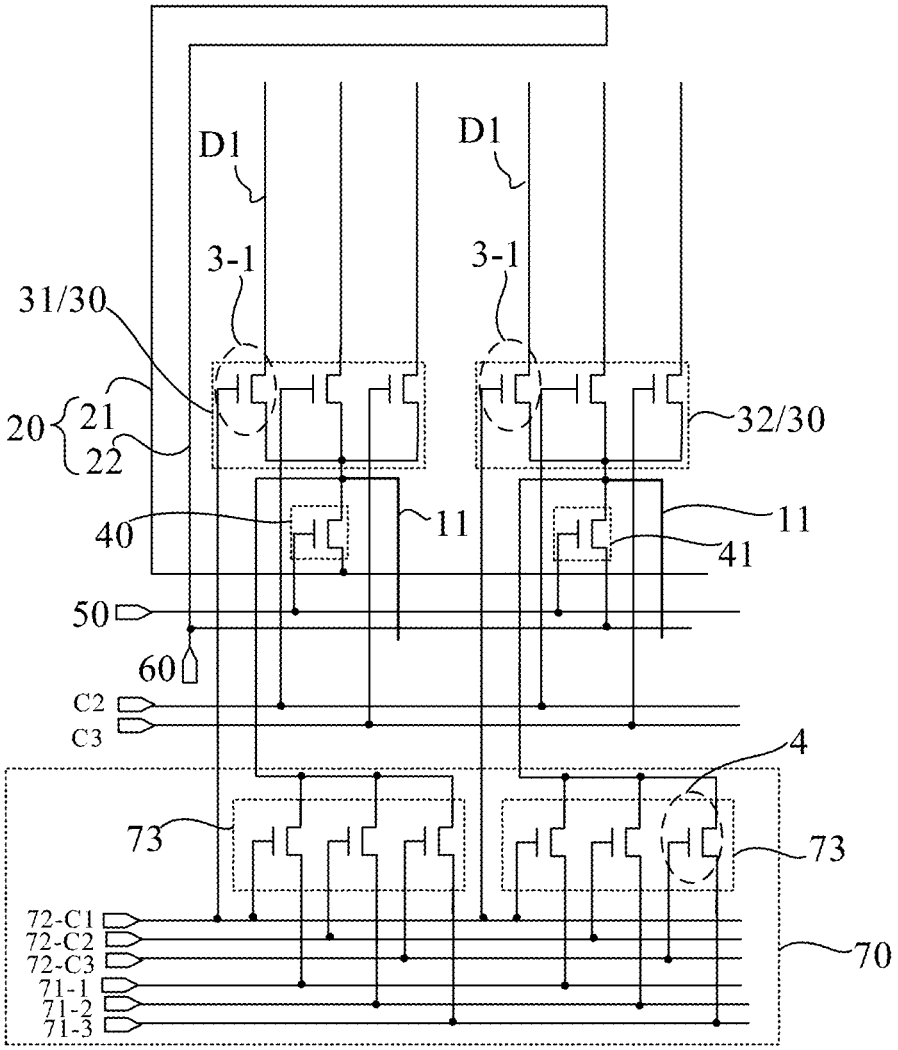
FIG. 20 is a schematic diagram a circuit of a display panel to which a detection method can be applied according to an embodiment of the present disclosure.

FIG. 19 is a flowchart of a method provided by an embodiment of the present disclosure, FIG. 20 is a schematic diagram of a circuit of a display panel to which the method provided by an embodiment of the present disclosure can be applied, the display panel provided in the embodiment of FIG. 20 can be detected by using the method provided in the embodiment of FIG. 19, and as shown in FIG. 20, the display panel further includes a second crack detection switch 41 provided in the non-display area, and the multiple demultiplexers include a second demultiplexer 32. The input terminal of the second demultiplexer 32 is connected to an output terminal of the second crack detection switch 41, one fan-out line, and the output terminal of one display test unit 73. A control terminal of the second crack detection switch 41 is electrically connected to the crack detection control signal line 50, and the input terminal of the second crack detection switch 41 is electrically connected to the crack detection signal terminal 60.

As shown in FIG. 19, the detection method includes steps S401, S402, and S401.

At step S401, a crack detection signal is provided to the crack detection line 20.

At step S402, at the first moment, the first crack detection switch 40 is controlled to be turned on, the first crack detection switch 40 provides a first voltage signal of the input terminal thereof to the input terminal of the first demultiplexer 31, and at the same time, the output terminal of the selection switch 4 is controlled to provide a test signal to the input terminal of the first demultiplexer 31, to control the first demultiplexer 31 to provide the second voltage signal to n data lines D electrically connected thereto. The second crack detection switch 41 is controlled to be turned on, the crack detection signal terminal 60 provides a fourth voltage signal to the input terminal of the second demultiplexer 32, and at the same time, the output terminal of the selection switch 4 is controlled to provide a test signal to the input terminal of the second demultiplexer 32, to control the second demultiplexer 32 to provide a fifth voltage signal to n data lines electrically connected thereto.

At step S403, at the second moment, the first crack detection switch 40 is controlled to be turned off, and at the same time, the output terminal of the selection switch 4 is controlled to provide a test signal to the input terminal of the first demultiplexer 31, and the first demultiplexer 31 is controlled to provide a third voltage signal to the n data lines D electrically connected thereto; and the second crack detection switch 41 is controlled to be turned off, and at the same time, the output terminal of the selection switch 4 is controlled to provide a test signal to the input terminal of the second demultiplexer 32, to control the second demultiplexer 32 to provide a sixth voltage signal to the n data lines electrically connected thereto.

In the two cases where the crack detection line 20 is broken and not broken, description of the voltage signal received at the input terminal of the first demultiplexer 31 at the first moment and the second moment can be referred to the description of the embodiment in FIG. 18, and it will not be repeated herein.

At the first moment, the second crack detection switch 41 is controlled to be turned on, then the input terminal of the second demultiplexer 32 simultaneously receives the voltage signal provided by the second crack detection switch 41 and the voltage signal provided by the display test unit 73, and according to the description in the above embodiment in FIG. 3, a voltage value of the signal received by the input terminal of the second demultiplexer 32 is between a voltage value of the voltage signal provided by the second crack detection switch 41 and a voltage value of the voltage signal (i.e., the test signal) provided by the display test unit 73. Since a voltage is generated on the crack detection line 20 when the crack detection signal provided by the crack detection signal terminal 60 is transmitted on the crack detection line 20, when the crack detection line 20 is not broken, the voltage value of the voltage signal received by the input terminal of the first crack detection switch 40 is also smaller than the voltage value of the signal received by the input terminal of the second crack detection switch 41. Correspondingly, at the first moment, the brightness of the display area where the data lines connected to the first demultiplexer 31 are located is greater than the brightness of the display area where the data lines connected to the second demultiplexer 32 are located, that is, there is a difference in brightness between the detection area and the standard area, which can accurately distinguishing the detection area of the display panel. When the crack detection line 20 is broken, the input terminal of the first demultiplexer 31 only receives the test signal provided by the display test unit 73, and when the voltage value of the test signal is smaller than the voltage value of the crack detection signal, the voltage value of the signal received by the input terminal of the first demultiplexer 31 is smaller than the voltage value of the signal received by the input terminal of the second demultiplexer 32, then the brightness of the display area where the data lines connected to the first demultiplexer 31 are located is greater than the brightness of the display area where the data lines connected to the second demultiplexer 32 are located, which can accurately distinguishing the detection area of the display panel.

Similarly, at the second moment, both the first crack detection switch 40 and the second crack detection switch 41 are turned off, then the input terminal of the first demultiplexer 31 only receives the test signal provided by the display test unit 73, the input terminal of the second demultiplexer 32 also only receives the test signal provided by the display test unit 73, and the brightness of the display area where the data lines connected to the first demultiplexer 31 are located is approximately the same as the brightness of the display area where the data lines connected to the second demultiplexer 32 are located. There is no difference in brightness between the detection area and the standard area at this moment.

Using the method provided in the above steps S401 to S403 can determine whether the crack detection line is broken, and when there is no brightness difference of the detection area at the first moment and the second moment, it is determined that the crack detection line is broken; when there is a difference between the brightness of the detection area at the first moment and the brightness of the detection area at the second moment, it is determined that the crack detection line is not broken. Therefore, it can be determined whether there is a crack at the edge of the display panel, and the defective product can be detected before they leave the factory.

After the detection of the display panel provided by the embodiment in FIG. 20 is completed, before leaving the factory, the output terminal of the display test unit and the input terminal of the demultiplexer are disconnected through a fusing process, to obtain the display panel provided by the embodiment of the present disclosure. In another embodiment, the control terminal of the selection switch that shares the test control line with the distribution switch is disconnected from the test control line through a fusing process, to obtain the display panel provided by the embodiment of the present disclosure.

Figure 21:
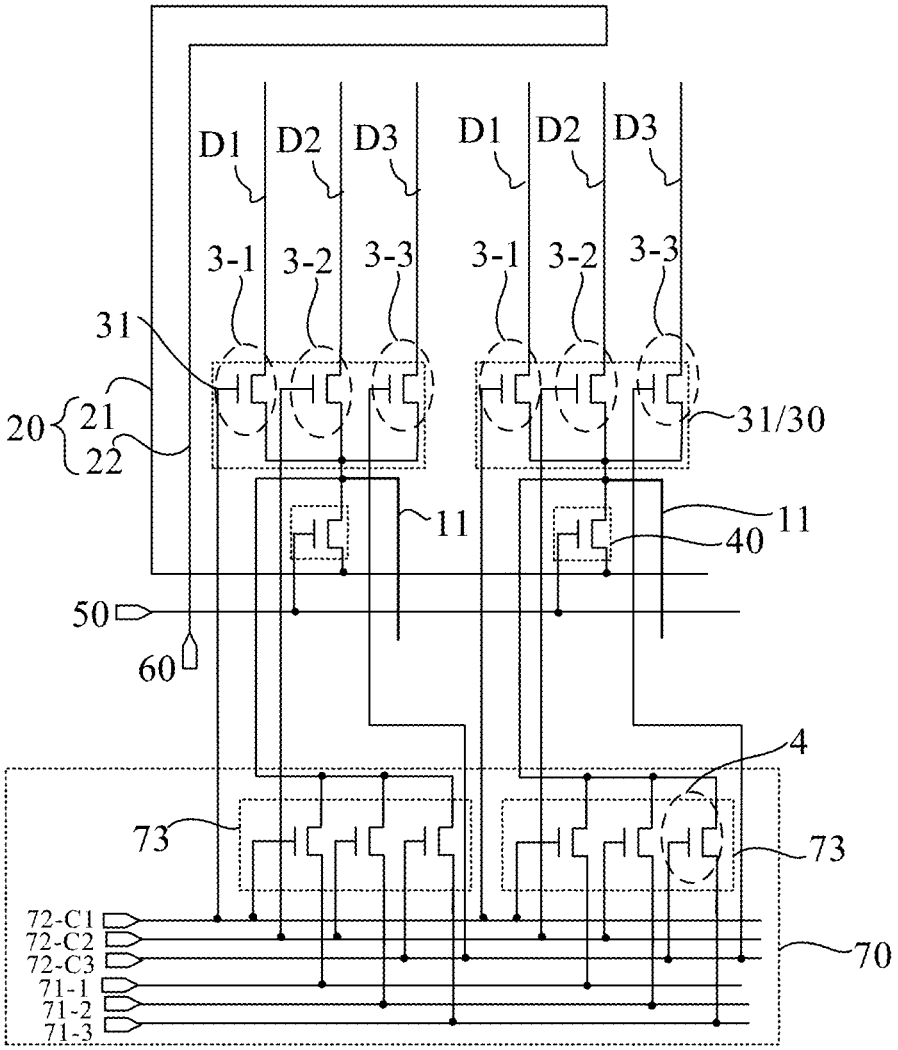
FIG. 21 is a schematic diagram of a circuit in a display panel to which a detection method can be applied according to an embodiment of the present disclosure.

FIG. 21 is a schematic diagram of a circuit of a display panel to which the method for detecting the display panel provided by an embodiment of the present disclosure can be applied. In an embodiment, as shown in FIG. 21, the demultiplexer further includes at least one second distribution switch 3-2 and at least one third distribution switch 3-3, both an input terminal of the second distribution switch 3-2 and an input terminal of the third distribution switch 3-3 are electrically connected to the input terminal of the demultiplexer 30, an output terminal of the second distribution switch 3-2 is electrically connected to the second data line D2, the second data line D2 is connected to sub-pixels of the same color (i.e., a second color), an output terminal of the third distribution switch 3-3 is electrically connected to the third data line D3, the third data line D3 is connected to sub-pixels of the same color (i.e., a third color), and the first color, the second color, and the third color are respectively three different colors. The three test control lines include a first test control line 72-C1, a second test control line 72-C2, and a third test control line 72-C3. A control terminal of the first distribution switch 3-1 is electrically connected to the first test control line 72-C1, a control terminal of the second distribution switch 3-2 is electrically connected to the second test control line 72-C2, and a control terminal of the third distribution switch 3-3 is electrically connected to the third test control line 72-C3. FIG. 21 only illustrates that the demultiplexer includes one first distribution switch 3-1, one second distribution switch 3-2, and one third distribution switch 3-3.

The display panel illustrated in FIG. 21 can be detected using the steps S301 to S303, to determine whether the crack detection line is broken, and then determine whether there is a crack in the display panel.

In an embodiment, the step S302 includes: controlling the first test control line 72-C1, the second test control line 72-C2, and the third test control line 72-C3 to sequentially provide an effective level signal. The step of controlling the first test control line 72-C1, the second test control line 72-C2, and the third test control line 72-C3 to sequentially provide the effective level signal, indicates that the first test control line 72-C1, the second test control line 72-C2, and the third test control line 72-C3 do not provide the effective level signal concurrently, that is, the three selection switches of the display test unit are not turned on concurrently, and the distribution switches of the multiplexer are not turned on concurrently.

In an embodiment, the first test control line 72-C1 provides an effective level signal to control the selection switch 4 and the first distribution switch 3-1 that are connected to the test control line 72-C1 to be turned on, to cause the output terminal of the selection switch 4 to provide a test signal to the input terminal of the first demultiplexer 31, and at the same time, to cause the output terminal of the first distribution switch 3-1 to provide the second voltage signal to the data line D1 connected to the first distribution switch 3-1; the second test control line 72-C2 provides an effective level signal to control the selection switch 4 and the second distribution switch 3-2 that are connected to the second test control line 72-C2 to be turned on, to cause the output terminal of the selection switch 4 to provide a test signal to the input terminal of the first demultiplexer 31, and at the same time, to cause the output terminal of the second distribution switch 3-2 to provide the second voltage signal to the data line D2 connected to the second distribution switch 3-2; the third test control line 72-C3 provides an effective level signal to control the selection switch 4 and the third distribution switch 3-3 that are connected to the third test control line 72-C3 to be turned on, to cause the output terminal of the selection switch 4 to provide the test signal to the input terminal of the first demultiplexer 31, and at the same time, to cause the output terminal of the third distribution switch 3-3 to provide the second voltage signal to the data line D3 connected to the third distribution switch 3-3.

At the step S302, when each test control line provides an effective level signal, the crack detection control signal line 50 is simultaneously controlled to provide an effective level signal, to control the first crack detection switch 40 to be turned on. When the crack detection line 20 is not broken, the first crack detection switch 40 provides the crack detection signal transmitted by the crack detection line 20 to the distribution switch in the on state, so that the data line connected to the distribution switch in the on state simultaneously receives the crack detection signal and the test signal that is provided by the output terminal of the selection switch 4. When the crack detection line 20 is broken, the crack detection line 20 cannot provide the crack detection signal to the input terminal of the first crack detection switch 40, then the input terminal of the distribution switch in the on state only receives the test signal provided by the output terminal of the selection switch 4, and correspondingly, the data line connected to the distribution switch in the on state receives the test signal provided by the output terminal of the selection switch 4. Therefore, in the case where the crack detection line 20 is in two states—broken and unbroken, voltage signals received by the n data lines connected to the first demultiplexer are different, then, in the two states, at the first moment, the brightness of the display area where the n data lines connected to the first demultiplexer are located is different.

The step S303 includes: controlling the first test control line 72-C1, the second test control line 72-C2, and the third test control line 72-C3 to sequentially provide an effective level signal. Specifically, the first test control line 72-C1 provides an effective level signal to control the selection switch 4 and the first distribution switch 3-1 that are connected thereto to be turned on, to cause the output terminal of the selection switch 4 to provide a test signal to the input terminal of the first demultiplexer 31, and at the same time, to cause the output terminal of the first distribution switch 3-1 to provide the third voltage signal to the data line D1 connected thereto; the second test control line 72-C2 provides an effective level signal to control the selection switch 4 and the second distribution switch 3-2 that are connected thereto to be turned on, to cause the output terminal of the selection switch 4 to provide a test signal to the input terminal of the first demultiplexer 31, and at the same time, to cause the output terminal of the second distribution switch 3-2 to provide the third voltage signal to the data line D2 connected thereto; the third test control line 72-C3 provides an effective level signal to control the selection switch 4 and the third distribution switch 3-3 that are connected thereto to be turned on, to cause the output terminal of the selection switch 4 to provide a test signal to the input terminal of the first demultiplexer 31, and at the same time, to cause the output terminal of the third distribution switch 3-3 to provide the third voltage signal to the data line D3 connected thereto.

At step S303, when each test control line provides an effective level signal, the crack detection control signal line 50 is simultaneously controlled to provide an ineffective level signal, to control the first crack detection switch 40 to be turned off. Then, when each test control line provides an effective level signal in step S303, only the output terminal of the selection switch 4 provides a test signal to the input terminal of the distribution switch in the on state. Correspondingly, the data line connected to the distribution switch in the on state only receives the test signal provided by the output terminal of the selection switch 4. Then at the second moment, regardless of whether the crack detection line 20 is broken, the brightness of the display area where the n data lines D electrically connected to the first demultiplexer 31 are located remains unchanged, then the brightness of the display area where the n data lines D electrically connected to the first demultiplexer 31 are located at the second moment can be used as a comparative example, and by comparing the brightness of the display area where the n data lines D are located at the first moment and the second moment, a difference therebetween is obtained to determine whether the corresponding crack detection line 20 is broken.

When the brightness of the display area where the n data lines electrically connected to the first demultiplexer are located is different at the first moment and the second moment, it is determined that the crack detection line 20 is not broken, and then it can be determined that there is no crack at the edge of the display panel. When the brightness of the display area where the n data lines electrically connected to the first demultiplexer are located is the same at the first moment and the second moment, it is determined that the crack detection line 20 is broken, and then it can be determined that there is a crack at the edge of the display panel.

The method for detecting the display panel can detect whether the crack detection line in the display panel is broken, to further determine whether there is a crack at the edge of the display panel, so as to detect defective products before they leave the factory.

After the detecting the display panel provided in the embodiment of FIG. 21 and before the display panel leave the factory, the output terminal of the display test unit and the input terminal of the demultiplexer are disconnected through a fusing process, to obtain the display panel provided by the embodiment of the present disclosure. In an embodiment, the control terminal of the selection switch that shares the test control line with the distribution switch is disconnected from the test control line through a fusing process, to obtain the display panel provided by the embodiment of the present disclosure.

FIG. 22 is a flowchart of a method for detecting a display panel according to an embodiment of the present disclosure, and the method provided by the embodiment of FIG. 22 can detect the display panel in the embodiment of FIG. 20 or FIG. 21. As shown in FIG. 22, the detection method includes step S501.

At step S501, the three test control lines are controlled to sequentially provide an effective level signal to control the three selection switches 4 to be turned on sequentially, and at the same time, the crack detection control signal line 50 is controlled to provide an ineffective level signal to control the first crack detection switch 40 to be turned off; the three selection switches 4 sequentially provide the display test signals provided by the test signal lines connected to the input terminals thereof to the input terminal of the first demultiplexer 31, and the first demultiplexer 31 is controlled to respectively provide the display test signals to the n data lines D electrically connected thereto. At the step S501, the first crack detection switch 40 is controlled to be turned off, and for the display panel including the second crack detection switch, the crack detection control signal line 50 provides an ineffective level signal, which can also control the second crack detection switch to be turned off at the same time. Then at step S501, the input terminal of the demultiplexer is controlled to receive only the display test signal provided by the display test unit, and correspondingly, the display test signal can be provided to the data line through the distribution switch of the demultiplexer, thereby realizing the display test of the display panel.

When performing the display test on the display panel provided in the embodiment of FIG. 20, the step S501 includes: providing, by the first test control line 72-C1, an effective level signal to control the selection switch 4 connected thereto and the first distribution switch 3-1 connected thereto to be turned on, to cause the output terminal of the selection switch 4 to provide the display test signal to the input terminal of the first demultiplexer 31, and at the same time, to cause the output terminal of the first distribution switch 3-1 to provide a display test signal to the data line D1 connected thereto. With the above steps, the display test can be can performed on the display panel, and at this step, the first test control line can simultaneously control the selection switch and the first distribution switch that are connected to the first test control line, and by sharing one test control line, the number of the control signal lines is reduced, and the space occupied by the non-display area can be saved. When performing the display test, the demultiplexer connected to the fan-out line is provided to increase the integration level of the display panel.

When performing the display test on the display panel provided in the embodiment of FIG. 21, the step S501 includes: providing an effective level signal, by the first test control line 72-C1, to control the selection switch 4 connected thereto and the first distribution switch 3-1 connected thereto to be turned on, to cause the output terminal of the selection switch 4 to provide a display test signal to the input terminal of the first demultiplexer 31, and at the same time, to cause the output terminal of the first distribution switch 3-1 to provide a display test signal to the data line D1 connected thereto; providing, by the second test control line 72-C2, an effective level signal to control the selection switch 4 connected thereto and the second distribution switch 3-2 connected thereto to be turned on, to cause the output terminal of the selection switch 4 to provide a display test signal to the input terminal of the first demultiplexer 31, and at the same time, to cause the output terminal of the second distribution switch 3-2 to provide a display test signal to the data line D2 connected thereto; and providing, the third test control line 72-C3, an effective level signal to control the selection switch 4 connected thereto and the third distribution switch 3-3 connected thereto to be turned on, to cause the output terminal of the selection switch 4 to provide the display test signal to the input terminal of the first demultiplexer 31, and at the same time, to cause the output terminal of the third distribution switch 3-3 to provide a display test signal to the data line D3 connected thereto. With the above steps, the display test can be performed on the display panel, and at this step, the three test control lines can simultaneously control one selection switch and one distribution switch, and by sharing the test control lines, the number of the control signal lines is reduced, and the space occupied by the non-display area can be saved. When performing the display test, the demultiplexer connected to the fan-out line is provided to increase the integration level of the display panel.

The embodiment of FIG. 22 provides a display test method for the display panel provided in FIG. 20 and FIG. 21. After the display detection and the crack detection are performed on the display panel provided by the embodiment of FIG. 20 and FIG. 21 and before the display panel leave the factory, the output terminal of the display test unit and the input terminal of the demultiplexer are disconnected through a fusing process, to obtain the display panel provided by the embodiment of the present disclosure. In an embodiment, the control terminal of the selection switch that shares the test control line with the distribution switch is disconnected from the test control line through a fusing process, to obtain the display panel provided by the embodiment of the present disclosure.

The embodiment of FIG. 20 illustrates the case where the first distribution switch of the demultiplexer and the selection switch of the display test unit share one test control line, that is, the multiplexer and the display test unit share one test control line. The embodiment of FIG. 21 illustrates the case where the demultiplexer and the display test unit share three test control lines. In another embodiment, the demultiplexer and the display test unit share two test control lines, which will not be illustrated here, while the display panel provided by this embodiment can also use the above method to perform the crack detection and the display test on the display panel.

An embodiment of the present disclosure also provides a display device. FIG. 23 is a schematic diagram of the display device provided by the embodiment of the present disclosure. As shown in FIG. 23, the display device includes the display panel 100 provided by any one embodiment of the present disclosure. The structure of the display panel has been described in the above embodiments and will not be repeated herein. The display device in the embodiment of the present disclosure can be a device with a display function, such as a mobile phone, a tablet computer, a notebook computer, an electronic paper book, a television, and a smart wearable product.

The above are only preferred embodiments of the present disclosure and are not intended to limit the present disclosure. Any modification, equivalent replacement, improvement, etc. made within the principle of the present disclosure should be included in the protection scope of the present disclosure.

Finally, it should be noted that the various embodiments above are only used to illustrate the technical solution of the present disclosure, rather than limiting the protection scope of the present disclosure; although the present disclosure has been described in detail with reference to the various embodiments above, those ordinary skilled in the art should understand that: they can still modify the technical solutions described in the various embodiments above or equivalently replace some or all of the technical features; while these modifications or replacements do not cause the essence of the corresponding technical solutions to depart from the scope of the technical solutions of the various embodiments of the present disclosure.

What is claimed is:

1. A display panel, the display panel having a display area and a non-display area at least partially surrounding the display area, and the non-display area comprising a fan-out area;

the display panel comprising:

a plurality of fan-out lines arranged in the fan-out area;

a plurality of data lines arranged in the display area; and a plurality of demultiplexers, a crack detection line, a first crack detection switch and a crack detection control signal line that are arranged in the non-display area, wherein the crack detection line and the first crack detection switch are configured to detect whether there is a crack in the display panel, and the first crack detection switch comprises an input terminal electrically connected to the crack detection line, an output terminal, and a control terminal electrically connected to the crack detection control signal line;

wherein each of the plurality of demultiplexers comprises output terminals electrically connected to n data lines of the plurality of data lines, respectively, an input terminal and at least one control terminal, and is configured to provide a signal of the input terminal of the demultiplexer to one of the n data lines connected to the demultiplexer under control of a signal of one of the at least one control terminal, where n is a positive integer, and $n \geq 2$; and wherein the plurality of the demultiplexers comprises a first demultiplexer, wherein the input terminal of the first demultiplexer is connected to the output terminal of the first crack detection switch and one of the plurality of fan-out lines.

2. The display panel according to claim 1, wherein the crack detection line surrounds the display area and comprises a first detection sub-line and a second detection sub-line that are connected to each other, wherein the first detection sub-line and the second detection sub-line each extend along a first direction;

wherein along a second direction intersecting with the first direction, there is a gap between an orthographic projection of the first detection sub-line on a light-exiting surface of the display panel and an orthographic projection of the second detection sub-line on the light-exiting surface of the display panel; and wherein the first detection sub-line is connected to the input terminal of the first crack detection switch, and the second detection sub-line is connected to a crack detection signal terminal.

3. The display panel according to claim 1, wherein each of the plurality of fan-out lines is a data signal line configured to provide a data signal to one of the plurality of data lines during a display phase of the display panel.

4. The display panel according to claim 1, further comprising:

a display test module arranged in the non-display area, wherein the display test module comprises three test signal lines and three test control lines, wherein each of the plurality of demultiplexers comprises at least one first distribution switch, wherein each of the at least one first distribution switch comprises an input terminal electrically connected to the input terminal of the demultiplexer, an output terminal electrically connected to a first data line of the n data lines connected to the demultiplexer, and a control terminal electrically connected to one of the three test control lines, and the first data line is connected to a plurality of sub-pixels of a first color.

5. The display panel according to claim 4, wherein the display test module further comprises a plurality of display test units corresponding to the plurality of demultiplexers; and wherein one of the plurality of display test units comprises three selection switches, wherein each of the three selection switches comprises a control terminal electrically connected to one of the three test control lines, and an input terminal electrically connected to one of the three test signal lines.

6. The display panel according to claim 4, wherein the three test control lines comprise a first test control line, a second test control line, and a third test control line;

wherein the control terminal of each of the at least one first distribution switch is electrically connected to the first test control line;

wherein each of the plurality of demultiplexers further comprises at least one second distribution switch, wherein each of the at least one second distribution switch comprises an input terminal electrically connected to the input terminal of the demultiplexer, an output terminal electrically connected to a second data line of the n data lines connected to the demultiplexer, and a control terminal electrically connected to the second test control line; and wherein the second data line is connected to sub-pixels of a second color, and the first color is different from the second color.

7. The display panel according to claim 6, wherein each of the plurality of demultiplexers further comprises at least one third distribution switch, wherein each of the at least one third distribution switch comprises an input terminal electrically connected to the input terminal of the demultiplexer, an output terminal electrically connected to a third data line of the n data lines connected to the demultiplexer, and a control terminal electrically connected to the third test control line; and wherein the third data line is connected to sub-pixels of a third color, and the first color, the second color and the third color are different from one another.

8. The display panel according to claim 7, wherein the at least one first distribution switch comprises at least two first distribution switches, the at least one second distribution switch comprises at least two second distribution switches, and the at least one third distribution switch comprises at least two third distribution switches.

9. The display panel according to claim 1, further comprising:

a display test module arranged in the non-display area, wherein the display test module comprises three test signal lines, three test control lines, and a plurality of display test units; and wherein each of the plurality of display test units comprises three selection switches, wherein each of the three selection switches comprises an input terminal electrically connected to one of the three test signal lines, and an output terminal; and output terminals of the three selection switches are electrically connected to the input terminal of one of the plurality of demultiplexers.

10. The display panel according to claim 9, wherein each of the plurality of demultiplexers comprises at least one first distribution switch, wherein each of the at least one first distribution switch comprises a control terminal electrically connected to one of the three test control lines, an input terminal electrically connected to the input terminal of the demultiplexer, and an output terminal electrically connected to a first data line of the n data lines connected to the demultiplexer; and wherein the first data line is connected to sub-pixels of a first color.

11. The display panel according to claim 10, wherein the three test control lines comprise a first test control line, a second test control line, and a third test control line;

wherein the control terminal of each of the at least one first distribution switch is electrically connected to the first test control line;

wherein each of the plurality of demultiplexers further comprises at least one second distribution switch and at least one third distribution switch, wherein each of the at least one second distribution switch comprises an input terminal electrically connected to the input terminal of the demultiplexer, an output terminal electrically connected to a second data line of the n data lines connected to the demultiplexer, and a control terminal electrically connected to the second test control line; and each of the at least one third distribution switch comprises an input terminal electrically connected with the input terminal of the demultiplexer, an output terminal electrically connected to a third data line of the n data lines connected to the demultiplexer, and a control terminal electrically connected to the third test control line; and wherein the second data line is connected to sub-pixels of a second color, the third data line is connected to sub-pixels of a third color, and the first color, the second color and the third color are different from one another.

12. The display panel according to claim 1, further comprising:

a second crack detection switch arranged in the non-display area, wherein the plurality of the demultiplexers further comprises a second demultiplexer; and wherein the second crack detection switch comprises a control terminal electrically connected to the crack detection control signal line, an input terminal electrically connected to a crack detection signal terminal, and an output terminal electrically connected to the input terminal of the second demultiplexer, wherein the input terminal of the second demultiplexer is further electrically connected to one of the plurality of fan-out lines.

13. A display device, comprising the display panel according to claim 1.

14. A method for detecting a display panel, wherein the display panel has a display area and a non-display area at least partially surrounding the display area, and the non-display area comprises a fan-out area;

wherein the display panel comprises: a plurality of fan-out lines arranged in the fan-out area; a plurality of data lines arranged in the display area; and a plurality of demultiplexers, a crack detection line, a first crack detection switch and a crack detection control signal line that are arranged in the non-display area;

wherein the crack detection line surrounds the display area and comprises a first detection sub-line and a second detection sub-line that are connected to each other, wherein the first detection sub-line and the second detection sub-line each extend along a first direction; along a second direction intersecting with the first direction, there is a gap between an orthographic projection of the first detection sub-line on a light-exiting surface of the display panel and an orthographic projection of the second detection sub-line on the light-exiting surface of the display panel; and the first detection sub-line is connected to an input terminal of the first crack detection switch, and the second detection sub-line is connected to a crack detection signal terminal;

wherein each of the plurality of demultiplexers comprises output terminals electrically connected to n data lines of the plurality of data lines, respectively, an input terminal and at least one control terminal, and is configured to provide a signal of the input terminal of the demultiplexer to one of the n data lines connected to the demultiplexer under control of a signal of one of the at least one control terminal, where n is a positive integer, and $n \geq 2$; and the plurality of the demultiplexers comprises a first demultiplexer, wherein the input terminal of the first demultiplexer is connected to an output terminal of the first crack detection switch and one of the plurality of fan-out lines;

wherein a control terminal of the first crack detection switch is electrically connected to the crack detection control signal line; and wherein the method comprises:

providing a crack detection signal to the crack detection line;

at a first moment, controlling the first crack detection switch to be turned on in such a manner that the first crack detection switch provides a first voltage signal of the input terminal of the first crack detection switch to the input terminal of the first demultiplexer, and at the same time, providing a test signal to the input terminal of the first demultiplexer through the one of the plurality of fan-out lines, and controlling the first demultiplexer to provide a second voltage signal to the n data lines electrically connected to the first demultiplexer;

at a second moment, controlling the first crack detection switch to be turned off, and at the same time, providing the test signal to the input terminal of the first demultiplexer through the one of the plurality of fan-out lines, and controlling the first demultiplexer to provide a third voltage signal to the n data lines electrically connected to the first demultiplexer; and determining whether the crack detection line is broken based on a brightness difference obtained by comparing brightness of a part of the display area where the n data lines electrically connected to the first demultiplexer are located at the first moment and brightness of the part of the display area where the n data lines electrically connected to the first demultiplexer are located at the second moment.

15. The method according to claim 14, wherein the display panel further comprises a second crack detection switch arranged in the non-display area; the plurality of demultiplexers further comprises a second demultiplexer; the second crack detection switch comprises a control terminal electrically connected to the crack detection control signal line, an input terminal electrically connected to a crack detection signal terminal, and an output terminal electrically connected to the input terminal of the second demultiplexer, and the input terminal of the second demultiplexer is further electrically connected to one of the plurality of fan-out lines; and wherein the method further comprises:

at the first moment, controlling the second crack detection switch to be turned on in such a manner that the crack detection signal terminal provides a fourth voltage signal to the input terminal of the second demultiplexer, and at the same time, providing the test signal to the input terminal of the second demultiplexer through the fan-out line connected to the input terminal of the second demultiplexer, and controlling the second demultiplexer to provide a fifth voltage signal to the n data lines electrically connected to the second demultiplexer; and at the second moment, controlling the second crack detection switch to be turned off, and at the same time, providing the test signal to the input terminal of the second demultiplexer through the second fan-out line, and controlling the second demultiplexer to provide a sixth voltage signal to the n data lines electrically connected to the second demultiplexer.

16. A method for detecting a display panel, wherein the display panel has a display area and a non-display area at least partially surrounding the display area, and the non-display area comprises a fan-out area;

wherein the display panel comprises: a plurality of fan-out lines arranged in the fan-out area; a plurality of data lines arranged in the display area; a plurality of demultiplexers, a crack detection line, a first crack detection switch, a crack detection control signal line, and a display test module that are arranged in the non-display area;

wherein the crack detection line surrounds the display area and comprises a first detection sub-line and a second detection sub-line that are connected to each other, wherein the first detection sub-line and the second detection sub-line each extend along a first direction; along a second direction intersecting with the first direction, there is a gap between an orthographic projection of the first detection sub-line on a light-exiting surface of the display panel and an orthographic projection of the second detection sub-line on the light-exiting surface of the display panel; and the first detection sub-line is connected to an input terminal of the first crack detection switch, and the second detection sub-line is connected to a crack detection signal terminal;

wherein each of the plurality of demultiplexers comprises output terminals electrically connected to n data lines of the plurality of data lines, respectively, an input terminal and at least one control terminal, and is configured to provide a signal of the input terminal of the demultiplexer to one of the n data lines under control of a signal of one of the at least one control terminal, where n is a positive integer, and n≥2; and the plurality of the demultiplexers comprises a first demultiplexer, wherein the input terminal of the first demultiplexer is connected to an output terminal of the first crack detection switch and one of the plurality of fan-out lines;

wherein a control terminal of the first crack detection switch is electrically connected to the crack detection control signal line; each of the plurality of demultiplexers comprises at least one first distribution switch, wherein each of the at least one first distribution switch comprises an input terminal electrically connected to the input terminal of the demultiplexer, and an output terminal electrically connected to a first data line of the n data lines connected to the demultiplexer; and the first data line is connected to sub-pixels of a first color;

wherein the display test module comprises three test signal lines, three test control lines, and a plurality of display test units, wherein each of the plurality of display test units comprises at least three selection switches, wherein each of the at least three selection switches comprises a control terminal electrically connected to one of the three test control lines, an input terminal electrically connected to one of the three test signal lines, and an output terminal; and output terminals of the at least three selection switches are electrically connected to the input terminal of one of the plurality of demultiplexers;

wherein each of the at least one first distribution switch further comprises a control terminal electrically connected to one of the three test control lines; and wherein the method comprises:

providing a crack detection signal to the crack detection line;

at a first moment, controlling the first crack detection switch to be turned on in such a manner that the first crack detection switch provides a first voltage signal of the input terminal of the first crack detection switch to the input terminal of the first demultiplexer, and at the same time, controlling the output terminals of the at least three selection switches to provide a test signal to the input terminal of the first demultiplexer, and controlling the first demultiplexer to provide a second voltage signal to the n data lines electrically connected to the first demultiplexer; and at a second moment, controlling the first crack detection switch to be turned off, and at the same time, controlling the output terminals of the at least three selection switches to provide the test signal to the input terminal of the first demultiplexer, and controlling the first demultiplexer to provide a third voltage signal to the n data lines electrically connected to the first demultiplexer.

17. The method according to claim 16, wherein the display panel further comprises a second crack detection switch arranged in the non-display area; the plurality of demultiplexers further comprises a second demultiplexer; the second crack detection switch comprises a control terminal electrically connected to the crack detection control signal line, an input terminal electrically connected to the crack detection signal terminal, and an output terminal electrically connected to the input terminal of the second demultiplexer, and the input terminal of the second demultiplexer is further electrically connected to a second fan-out line of the plurality of fan-out lines and one output terminal of one of the plurality of display test units; and wherein the method further comprises:

at the first moment, controlling the second crack detection switch to be turned on in such a manner that the crack detection signal terminal provides a fourth voltage signal to the input terminal of the second demultiplexer, and at the same time, controlling the output terminals of the at least three selection switches to provide the test signal to the input terminal of the second demultiplexer, and controlling the second demultiplexer to provide a fifth voltage signal to the n data lines electrically connected to the second demultiplexer; and at the second moment, controlling the second crack detection switch to be turned off, and at the same time, controlling the output terminals of the at least three selection switches to provide the test signal to the input terminal of the second demultiplexer, and controlling the second demultiplexer to provide a sixth voltage signal to the n data lines electrically connected to the second demultiplexer.

18. The detection method according to claim 16, wherein said at the first moment, controlling the first crack detection to be turned on in such a manner that the first crack detection switch provides the first voltage signal of the input terminal of the first crack detection switch to the input terminal of the first demultiplexer, and at the same time, controlling the output terminals of the at least three selection switches to provide the test signal to the input terminal of the first demultiplexer, and controlling the first demultiplexer to provide the second voltage signal to the n data lines electrically connected to the first demultiplexer, comprises:

providing, by one of the at least three test control lines, an effective level signal to control the selection switch and the first distribution switch that are connected to the one of the three test control lines, to be turned on, so that the output terminal of the selection switch provides the test signal to the input terminal of the first demultiplexer, and at the same time, the output terminal of the first distribution switch provides the second voltage signal to the data line connected thereto; and wherein said at the second moment, controlling the first crack detection switch to be turned off, and at the same time, controlling the output terminals of the at least three selection switches to provide the test signal to the input terminal of the first demultiplexer, and controlling the first demultiplexer to provide the third voltage signal to the n data lines electrically connected to the first demultiplexer, comprises:

providing, by one of the three test control lines, an effective level signal to control the selection switch and the first distribution switch that are connected to the test control line, to be turned on, in such a manner that the output terminal of the selection switch provides the test signal to the input terminal of the first demultiplexer, and at the same time, the output terminal of the first distribution switch provides the third voltage signal to the data line connected thereto.

19. The detection method according to claim 16, wherein the three test control lines comprise a first test control line, a second test control line, and a third test control line;

wherein the control terminal of each of the at least one first distribution switch is electrically connected to the first test control line;

wherein each of the plurality of demultiplexers further comprises at least one second distribution switch and at least one third distribution switch, wherein each of the at least one second distribution switch comprises an input terminal electrically connected to the input terminal of the demultiplexer, an output terminal electrically connected to a second data line of the n data lines connected to the demultiplexer, and a control terminal electrically connected to the second test control line; and each of the at least one third distribution switch comprises an input terminal electrically connected to the input terminal of the demultiplexer, an output terminal electrically connected to a third data line of the n data lines connected to the demultiplexer, and a control terminal electrically connected to the third test control line; and wherein the second data line is connected to sub-pixels of a second color, the third data line is connected to sub-pixels of a third color; and the first color, the second color and the third color are different from one another; and wherein said at the first moment, controlling the first crack detection switch to be turned on in such a manner that the first crack detection switch provides the first voltage signal of the input terminal of the first crack detection switch to the input terminal of the first demultiplexer, and at the same time, controlling the output terminals of the at least three selection switches to provide the test signal to the input terminal of the first demultiplexer, and controlling the first demultiplexer to provide the second voltage signal to the n data lines electrically connected to the first demultiplexer, comprises:

controlling the first test control line, the second test control line, and the third test control line to sequentially provide an effective level signal, wherein the first test control line provides the effective level signal to control the selection switch and the first distribution switch that are connected to the first test control line to be turned on, in such a manner that the output terminal of the selection switch connected to the first test control line provides the test signal to the input terminal of the first demultiplexer, and at the same time, the output terminal of the first distribution switch connected to the first test control line provides the second voltage signal to the data line connected thereto; the second test control line provides the effective level signal to control the selection switch and the second distribution switch that are connected to the second test control line to be turned on, in such a manner that the output terminal of the selection switch connected to the second test control line provides the test signal to the input terminal of the first demultiplexer, and at the same time, the output terminal of the second distribution switch connected to the second test control line provides the second voltage signal to the data line connected thereto; and the third test control line provides the effective level signal to control the selection switch and the third distribution switch that are connected to the third test control line to be turned on, in such a manner that the output terminal of the selection switch connected to the third test control line provides the test signal to the input terminal of the first demultiplexer, and at the same time, the output terminal of the third distribution switch connected to the third test control line provides the second voltage signal to the data line connected thereto; and wherein said at the second moment, controlling the first crack detection switch to be turned off, and at the same time, controlling the output terminals of the at least three selection switches to provide the test signal to the input terminal of the first demultiplexer, and controlling the first demultiplexer to provide the third voltage signal to the n data lines electrically connected to the first demultiplexer, comprises:

controlling the first test control line, the second test control line, and the third test control line to sequentially provide an effective level signal, wherein the first test control line provides the effective level signal to control the selection switch and the first distribution switch that are connected to the first test control line to be turned on, in such a manner that the output terminal of the selection switch connected to the first test control line provides the test signal to the input terminal of the first demultiplexer, and at the same time, the output terminal of the first distribution switch connected to the first test control line provides the third voltage signal to the data line connected thereto; the second test control line provides the effective level signal to control the selection switch and the second distribution switch that are connected to the second test control line to be turned on, in such a manner that the output terminal of the selection switch provides the test signal to the input terminal of the first demultiplexer connected to the second test control line, and at the same time, the output terminal of the second distribution switch connected to the second test control line provides the third voltage signal to the data line connected thereto; the third test control line provides the effective level signal to control the selection switch and the third distribution switch that are connected to the third test control line to be turned on, in such a manner that the output terminal of the selection switch connected to the third test control line provides the test signal to the input terminal of the first demultiplexer, and at the same time, the output terminal of the third distribution switch connected to the third test control line provides the third voltage signal to the data line connected thereto.

20. The detection method according to claim 16, further comprising:

controlling the three test control lines to sequentially provide an effective level signal to control the three selection switches to be turned on sequentially, and at the same time, controlling the crack detection control signal line to provide an ineffective level signal to control the first crack detection switch to be turned off; and sequentially providing, by the three selection switches, a display test signal provided by the test signal lines connected to input terminals of the three selection switches to the input terminal of the first demultiplexer, and controlling the first demultiplexer to provide the display test signal to the n data lines electrically connected to the first demultiplexer, wherein each of the three test control lines provides the effective level signal to control the selection switch connected thereto and the first distribution switch connected thereto to be turned on, in such a manner that the output terminal of the selection switch connected to the test control line provides the display test signal to the input terminal of the first demultiplexer, and at the same time, the output terminal of the first distribution switch connected to the test control line provides the display test signal to the data line connected thereto.

* * * * *